US011769360B1

(12) United States Patent
Kelly et al.

(10) Patent No.: US 11,769,360 B1
(45) Date of Patent: Sep. 26, 2023

(54) INTERACTIVE TOUCHLESS INFORMATION EXCHANGE SYSTEM

(71) Applicant: Interactive Touchscreen Solutions, Inc., Crofton, MD (US)

(72) Inventors: Christopher Kelly, Crofton, MD (US); Natalie Bobila, Gaithersburg, MD (US); John Gonzales., Crofton, MD (US)

(73) Assignee: Interactive Touchscreen Solutions, Inc., Crofton, MD (US)

( * ) Notice: Subject to any disclaimer, the term of this patent is extended or adjusted under 35 U.S.C. 154(b) by 0 days.

(21) Appl. No.: 16/988,578

(22) Filed: Aug. 7, 2020

(51) Int. Cl.
*G07C 9/10* (2020.01)
*G07C 9/25* (2020.01)
*G07C 9/27* (2020.01)

(52) U.S. Cl.
CPC ..... *G07C 9/10* (2020.01); *G07C 9/257* (2020.01); *G07C 9/27* (2020.01)

(58) Field of Classification Search
CPC ... G07C 9/10; G07C 9/22; G07C 9/32; G07C 9/27; G07C 9/257
USPC ..... 340/5.61
See application file for complete search history.

(56) References Cited

U.S. PATENT DOCUMENTS 7,012,503 B2 * 3/2006 Nielsen ..... G07C 9/21 340/5.6
7,606,558 B2 * 10/2009 Despain ..... G07C 9/27 455/410
9,396,598 B2 * 7/2016 Daniel-Wayman ..... G07C 9/00309
9,449,449 B2 * 9/2016 Evans ..... H04W 12/082
9,640,002 B1 * 5/2017 Grasberg ..... G07C 9/00174
9,985,942 B2 * 5/2018 Williams ..... H04L 63/08
10,521,992 B2 * 12/2019 Troesch ..... G07C 9/00904
10,720,001 B1 * 7/2020 Grasberg ..... G07C 9/27
10,755,502 B2 * 8/2020 Sakurada ..... G07C 9/00896
10,810,816 B1 * 10/2020 Kocher ..... G07C 9/25
10,970,948 B2 * 4/2021 Gideon, III ..... H04L 63/107
11,182,997 B2 * 11/2021 Tagawa ..... G07C 9/257
11,314,898 B2 * 4/2022 Rhee ..... G06F 3/04883
2007/0176739 A1 * 8/2007 Raheman ..... G07C 9/00904 340/5.64
2012/0075057 A1 * 3/2012 Fyke ..... G07C 9/21 340/5.3
2014/0247111 A1 * 9/2014 Elfstrom ..... G07C 9/00309 340/5.61
2016/0125676 A1 * 5/2016 Pouille ..... G07C 9/257 340/5.7
2016/0247341 A1 8/2016 Talwerdi
2016/0307380 A1 * 10/2016 Ho ..... H04L 65/1069
2018/0286157 A1 * 10/2018 Simcik ..... G07C 9/00571
(Continued)

FOREIGN PATENT DOCUMENTS

WO WO-2020053638 A1 * 3/2020

*Primary Examiner* — Nam V Nguyen
(74) *Attorney, Agent, or Firm* — Muskin and Farmer LLC

(57) ABSTRACT

A method, system, and computer readable storage to enable a kiosk (or other interactive input/output device) in a building to allow a visitor to interact with it without physical contact (touching). The visitor can browse the tenant listing, request to visit a tenant of the building without an appointment, or visit a tenant in the building with an appointment. The visitor can use their own cell phone as an interface to interact with the kiosk and enable the functionality.

21 Claims, 29 Drawing Sheets

(56) References Cited

U.S. PATENT DOCUMENTS

2020/0372743 A1* 11/2020 Miller ..... G07C 9/27

* cited by examiner

Welcome to 328 Chauncey Street!

WANT TO BROWSE THE TENANT LIST?

SCAN THIS QR CODE:

HAVE AN APPOINTMENT?

SCAN THE QR CODE THAT WAS EMAILED TO YOU

NO APPOINTMENT?

SCAN YOUR DRIVER'S LICENSE

FIG. 10

Welcome to 328 Chauncey Street!

Thank you for scanning your license, Joe Smith.

Please scan the following QR code on your phone:

www.tenantsxys.com/328chancey/ACME

Scheduling system, ACME Anvil Company

The following visitor requests an instant appointment:

Name: Joe Smith
Company: Coyote Inc.
Temperature: 98.6 degrees
Stated business: discuss purchase

APPROVE DECLINE www.tenantsxys.com/328chancey/ACME

Scheduling system, ACME Anvil Company

Please enter:

Visitor's name:
Company:
Email address:
Phone number:
Date of appointment:
Time of appointment:

ENTER CANCEL

FIG. 18

Welcome to 328 Chauncey Street!

Hi Joe Smith. Your appointment today to visit ACME Anvil Co. is confirmed. The tenant you are Visiting, ACME Anvil Co. is being notified of your arrival. Your badge wil be texted to your cell phone. Please proceed to the turnstile and scan your badge.

FIG. 20

Welcome to 328 Chauncey Street!

Hi Joe Smith. Your appointment today to visit ACME Anvil Co. is at 2:30pm today, but the current time is 1:00pm. A badge is being texted to your cell phone. However, it will only operate after 2:15 pm.

FIG. 21

Welcome to 328 Chauncey Street!

Hi Joe Smith. Your appointment today to visit ACME Anvil Co. is at 2:30pm today, but it is now 4:00pm. You are too late. You can try calling the tenant or making an appointment as a non-scheduled visitor. Thank you.

FIG. 22

Scheduling system, ACME Anvil Company

Note that the following visitor is on his/her way to your office at 1:56pm, July 4, 2020:

Name: Joe Smith
Company: Coyote Inc.
Temperature: 98.6 degrees
Stated business: discuss purchase

INTERACTIVE TOUCHLESS INFORMATION EXCHANGE SYSTEM

BACKGROUND OF THE INVENTION

Field of the Invention

The present general inventive concept is directed to a method, apparatus, and computer readable storage medium directed to an interactive touchless information exchanging system.

Description of the Related Art

In office buildings, a visitor can interact with a kiosk in order to view the building tenants and learn the location of a particular tenant (e.g., what floor). Such kiosks can operate using a touchscreen where visitors can type in a name of a building tenant in order to see its location.

What is needed is a more sanitary system in which a visitor does not have to physically touch the screen.

SUMMARY OF THE INVENTION

It is an aspect of the present invention to provide an improved interactive information distribution system.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 10 is a sample output on an electronic output device associated with a kiosk, according to an embodiment;

FIG. 18 is a sample output on a computer screen on a computer used by a tenant prompting the tenant to enter appointment information, according to an embodiment;

FIG. 20 is a sample confirmation output on a kiosk screen, according to an embodiment;

FIG. 21 is a sample output on a kiosk screen informing the visitor that he/she is too early, according to an embodiment;

FIG. 22 is a sample output on a kiosk screen informing the visitor that he/she is too late, according to an embodiment;

DESCRIPTION OF THE PREFERRED EMBODIMENTS

Figure 1:
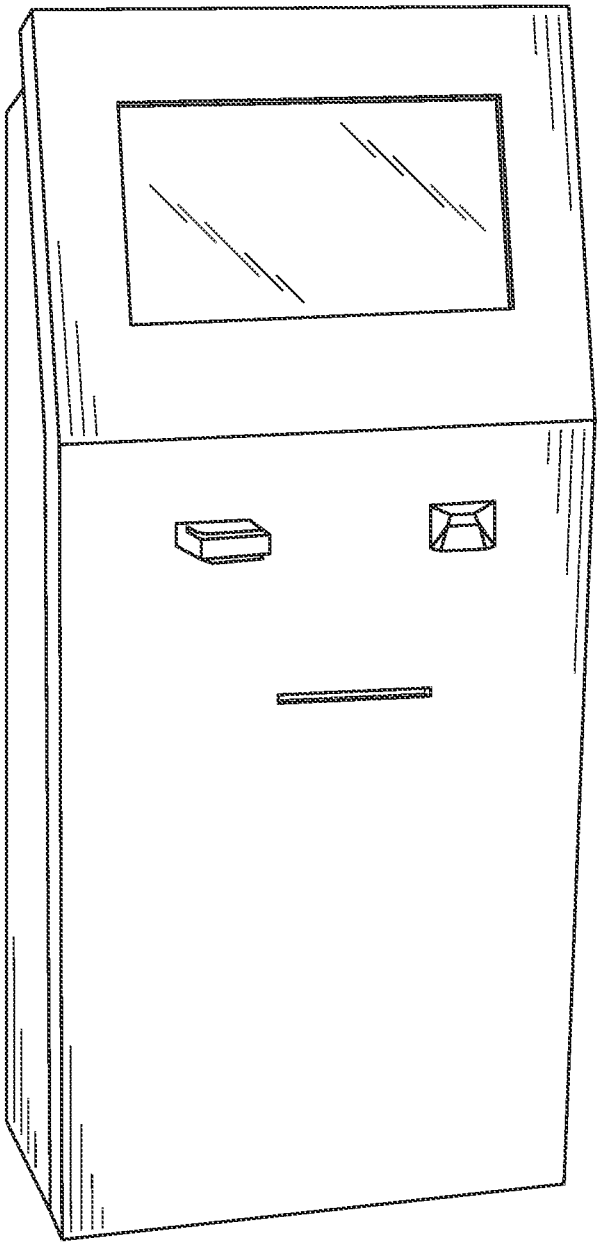
FIG. 1 is drawing of a screen within a free-standing kiosk of the kind that can implement the methods described herein, according to an embodiment.

Reference will now be made in detail to the presently preferred embodiments of the invention, examples of which are illustrated in the accompanying drawings, wherein like reference numerals refer to like elements throughout.

A building entry system which confirms that visitors are authorized to enter. A physical barrier (e.g., a turnstile, door, etc.) has a scanner (also referred to as camera) which can scan indicia to verify if a visitor is authorized to access. If the scanner at the barrier scans the indicia and it is determined that the visitor is authorized to access, then the physical barrier is open (unlocked, released, etc.) allowing the visitor to pass therethrough. Typically, access to most of the building is beyond the physical barrier (for example the only bank of elevators is beyond the turnstile). The default position of the physical barrier is closed, that is, a person would not be able to pass through the physical barrier unless the physical barrier is opened (unlocked, etc.). If a visitor does have authorization to pass through the barrier, then the barrier would be opened (unlocked, etc.) just for the one authorized visitor to pass and then would default back to the closed position (wherein nobody can pass therethrough). A kiosk (in the same building as the physical barrier, which both are typically in the building lobby) also has its own scanner (also referred to as camera) which can scan a visitor's driver's license (as well as other forms of identification such as a passport, etc.) as well as indicia and perform its own functionality. Typically, the building would have multiple kiosks which all have identical functions/structures. All of the kiosks that function with a physical barrier (enabling it to open) are typically all located in the same building. The physical barrier(s) and all of the kiosks that enable visitors to pass through the physical barrier(s) are all located in the same building and all typically located in the lobby of the building.

Since the building (but for publicly accessible parts of the lobby which is where the kiosks and the turnstile are located) is not generally accessible to the public, access is controlled by limited passage past the barrier (e.g., turnstile) to holders of valid badges. Visitors can obtain valid badges without physically touching touchscreens, buttons, or any other electrical devices, with the exception of the visitor's own cell phone (or own personal computer). However, most people do not mind touching their own personal devices as they are less likely to become contaminated as a device that has been touched by random strangers (such as a touchscreen in a public place).

Thus, the present inventive concept provides various workflows for visitors to schedule and gain access to a building without having to touch a publicly used/touch touchscreen, keyboard, buttons, etc.

FIG. 1 is drawing of a kiosk of the kind that can implement the methods described herein, according to an embodiment.

The kiosk can have an input/output device (e.g., a touchscreen) or just an output device (e.g., an LCD or CRT), a camera/scanner (a "kiosk scanner"), and a printer (which can print badges with QR codes (or other indicia). The kiosk can also have a no contact infrared thermometer (not pictured) which can read individual's body temperature, and store and transmit the temperatures digitally. This can be used to determine if someone currently has an elevated skin temperature which is above a normal range of human temperatures.

A visitor to a building may wish to browse the tenant list. This can be done with no touch contact (without physical contact with the kiosk) by the visitor utilizing his/her cell phone.

Figure 29:
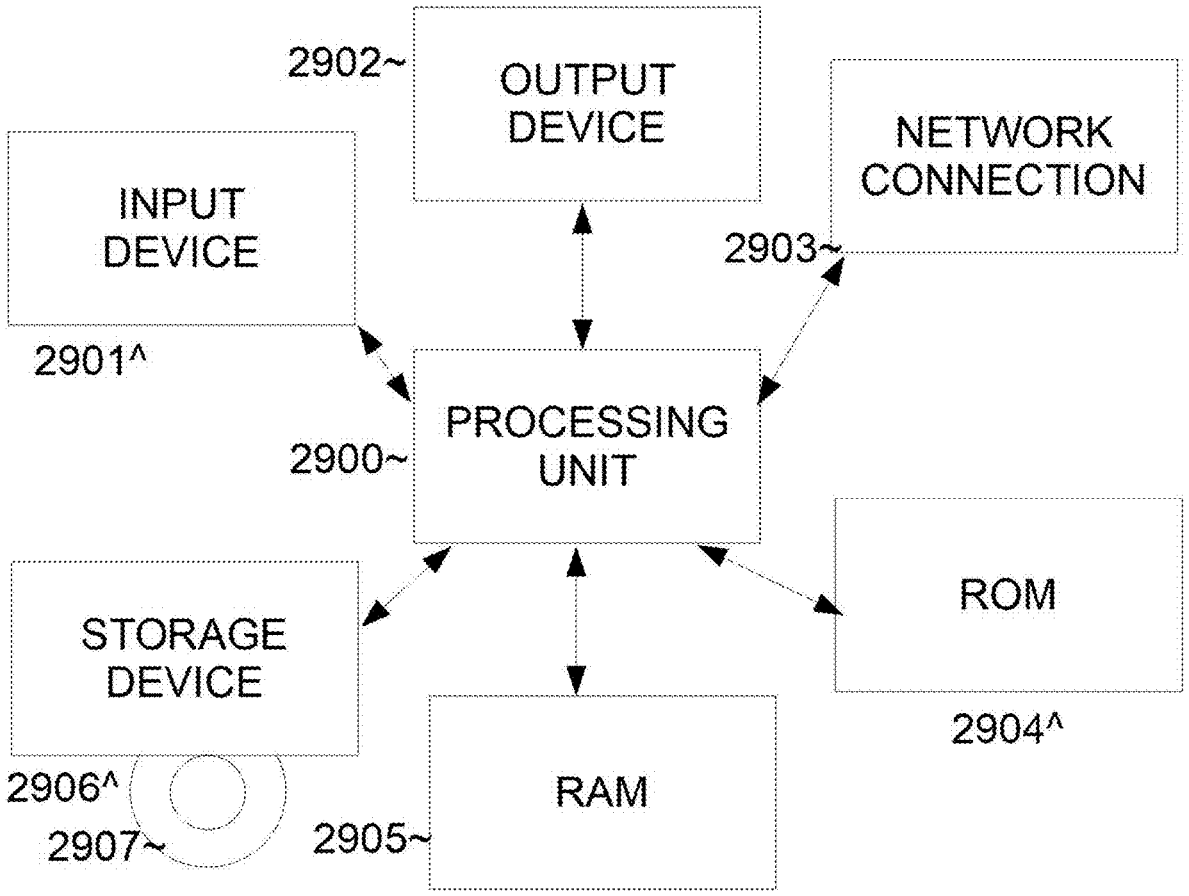
FIG. 29 is a block diagram of a computing device that can be used to implement any computer, server, processing unit, etc., according to an embodiment.

Note that in the alternative to a kiosk such as the one shown in FIG. 1, a device (for example with the logical structure such as illustrated in FIG. 29) can simply be an electronic output device (such as s tablet or other output device) utilizing a processing unit and any other optional connected components.

Figure 2:
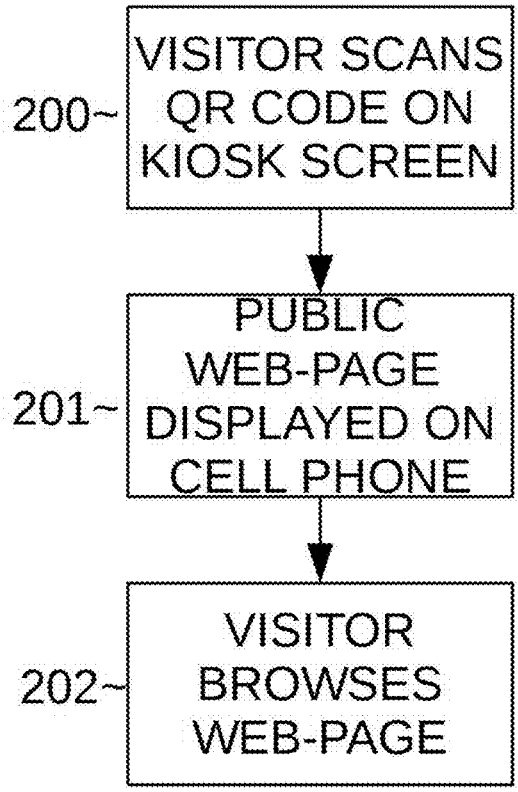
FIG. 2 is a flowchart illustrating an exemplary method of no touch contact browsing a tenant list, according to an embodiment.

FIG. 2 is a flowchart illustrating an exemplary method of browsing a tenant list with no-touch contact, according to an embodiment.

In operation 200, a visitor scans an indicia (or indicium) that is displayed (or generated) on the kiosk screen. The indicia can typically be a QR code which encodes information such as a web site address, a text string, etc. However, indicia as used herein can also include other (visual) indicia such as a 2-d bar code, snap-tag, etc. In addition, indicia can also include non-optical mechanism, for example near field communication tag, data-over-audio, etc. When the visitor scans the indicia, the visitor's cell phone would automatically open a web browser which visits a web address encoded in the indicia. This process can be done innately (e.g., the phone's operating system can automatically recognize a QR code or other indicia and automatically open its browser to the encoded web address). Alternatively, this process can occur manually, for example, the visitor runs an app on his/her cell phone (which came pre-installed on the cell phone or was downloaded by the visitor or other user of the cell phone) which scans for QR codes (or other indicia) and when one is present, automatically opens the cell phone's browser to a web page encoded in/on the indicia.

Thus, in operation 201, the cell phone has decoded the web page (URL) from the indicia and opens the browser to that web page. The web page can be maintained by the building and can display a current list of the building tenants and their respective floor/office number. The list can also include a short description of each tenant (e.g., the type of business they are in, their hours, etc.)

In operation 202, the visitor can browse the web-page (from operation 201) on their cell phone. In other words, the visitor can scroll up/down, select displayed tenants for further information, etc.

In this manner, a visitor to a building can physical approach a kiosk and utilize his/her own cell phone in order to browse the tenant list without having to physically touch the kiosk. If the visitor does not have a cell phone or does not wish to utilize his/her cell phone, the visitor can alternatively touch the kiosk and utilize its touchscreen to browse the tenant list in a conventional fashion.

In an embodiment, a non-scheduled visitor (a visitor who does not currently have an appointment with a tenant he/she wishes to visit at that time) will visit a building and desires to visit a tenant. Typically, for security reasons, non-scheduled visitors are not permitted general access to a building without authorization from a tenant. In addition, tenants generally would not wish to be hassled by non-scheduled visitors without at least evaluating whether they have the time and/or interest in seeing the non-scheduled visitor. For this reason, non-scheduled visitors can present their credentials (e.g., a driver's license) and the tenant the non-scheduled visitor wishes to visit can be queried to see if and when the non-scheduled visitor can visit the particular tenant.

Figure 3:
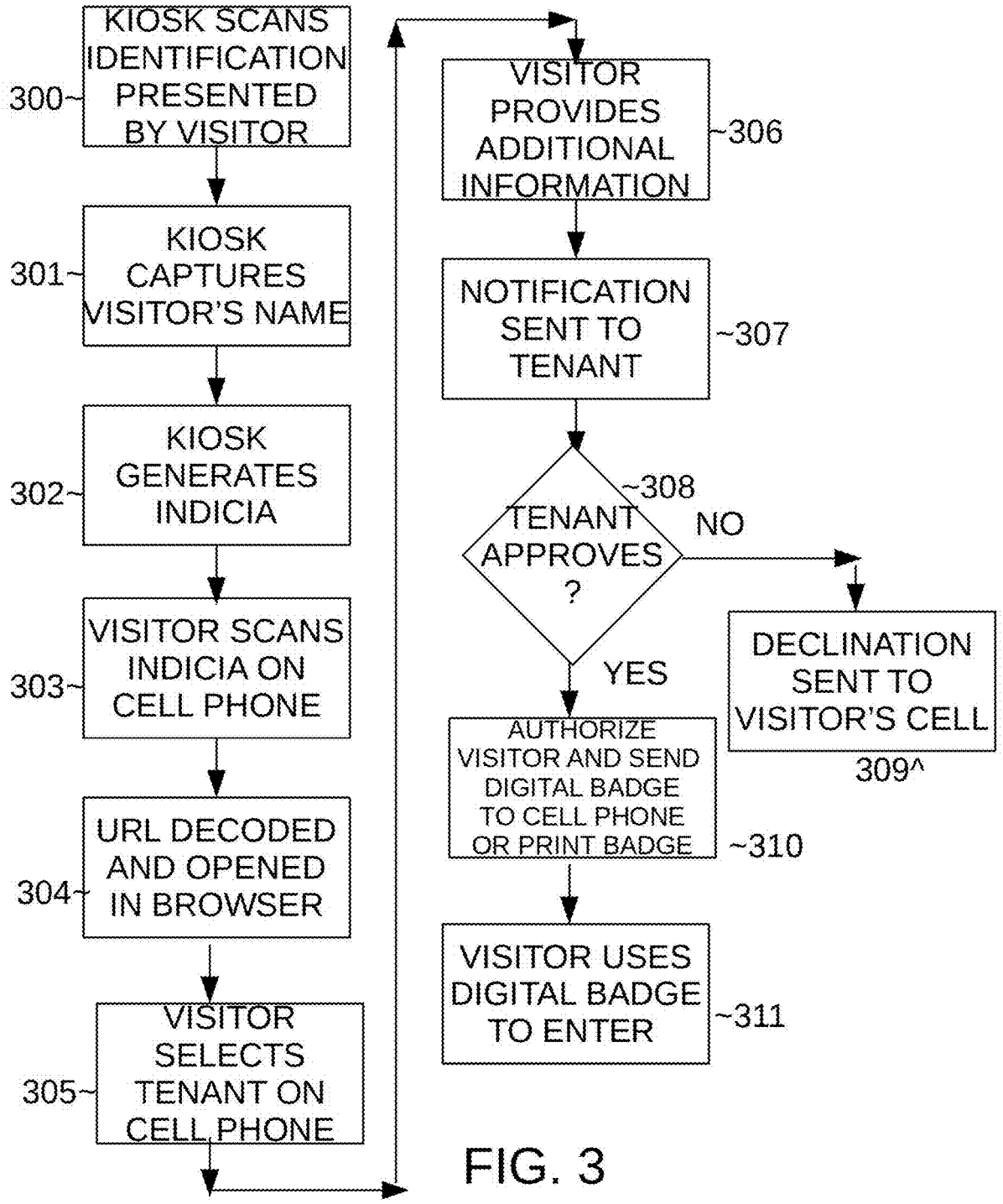
FIG. 3 is a flowchart illustrating an exemplary method of processing a non-scheduled visitor with no touch contact, according to an embodiment.

FIG. 3 is a flowchart illustrating an exemplary method of processing a non-scheduled visitor with no touch contact, according to an embodiment.

The method can begin with operation 300, in which a non-scheduled visitor physically approaches the kiosk and presents (shows) his/her identification to a scanner on the kiosk so that the scanner can scan (take a digital picture) of the identification. The identification is typically a driver's license.

From operation 300, the method proceeds to operation 301, wherein the kiosk (actually a computer running inside the kiosk) uses optical character recognition in order to capture (recognize) the non-scheduled visitor's name (e.g., first name, last name). The kiosk can also capture additionally information as well, such as the non-scheduled visitor's address (or just his/her home state), etc. The kiosk would typically store (in long term storage) the picture of the identification along with the time the identification was scanned for security reasons.

Note that in an embodiment, instead of the front of the driver's license being scanned (in any embodiment described herein), the visitor can scan a barcode that appears on the back of a driver's license. This barcode contains an encoded form of the visitor's name (last and first), which is the only relevant data that is utilized. No other personal information is utilized or stored. In another embodiment, additional information, such as address, date of birth, first name, last name, etc., can be decoded, stored and utilized.

From operation 301, the method proceeds to operation 302, wherein the kiosk generates indicia. For example, a QR code is displayed on the output device of the kiosk (although as stated herein, the indicia can be any other representation of data, visual or non-visual, such as a bar-code, snap-code, near field communication, etc.)

From operation 302, the method proceeds to operation 303, wherein the non-scheduled visitor scans the indicia on his/her cell phone. This can be done manually (e.g., the non-scheduled visitor physically positions the camera on his/her cell phone to take a digital image of the indicia) or automatically (e.g., the cell phone can automatically detect and decode a near field communication). The scanning by the cell phone can be accomplished automatically in the background (e.g., no special action need be taken by the non-scheduled visitor on his/her cell phone) or manually (e.g., the non-scheduled visitor runs an app on his/her cell phone in order to accomplish the scan). A web address (e.g., URL) that was encoded in the indicia is decoded.

From operation 303, the method proceeds to operation 304, wherein the web address that was encoded in the indicia is now opened on the cell phone's browser. The non-scheduled visitor can now browse the listing of tenants in the building and can scroll through the list until the non-scheduled visitor finds the tenant he/she desires to visit.

From operation 304, the method proceeds to operation 305, wherein the visitor selects (e.g., by touching, etc.) a tenant name displayed on his/her cell phone screen that he/she wishes to visit.

From operation 305, the method proceeds to operation 306, in which the web site (or app) the non-scheduled visitor would prompt the non-scheduled visitor to enter additional information which can comprise any combination of information such as purpose of visit, estimated length of visit, the non-scheduled visitor's email address, etc., The system would automatically already know the non-scheduled visitor's name from operation 301, which could then be embedded into the URL from operation 304 (or the web page stored on the URL could be pre-populated with the information captured from the user's identification so when the webpage is opened, the forms are already filled in with the respective information (name, address, etc.) Thus, the user should not have to type in his/her name and address again.

From operation 306, the method proceeds to operation 307, wherein a notification (e.g., a text, email, automated call, etc.) is sent to the tenant (selected by the non-scheduled visitor in operation 304) that the non-scheduled visitor wishes to visit. This notification can be sent by a server dedicated to the operation of the kiosk. For example, an email can be sent to an email address on file for the tenant and it identifies the non-scheduled visitor by name and prompts for a reply (e.g., by text, email, etc.) to either approve or decline the requested visit. The tenant's answer is then transmitted back to the server for further processing. The notification can include things such as a picture of the non-scheduled visitor, his temperature (the kiosk can be equipped with a temperature sensing device), etc. The tenant can use this information when deciding whether to approve or decline (deny/denial) the visit.

From operation 307, the method proceeds to operation 308, which determines whether the tenant approved or declined the request. If in operation 308 the tenant declined the request, then the method proceeds to operation 309, where a notice is transmitted to the non-scheduled visitor's cell phone that his/her request was declined and that the non-scheduled visitor will not be able to access the building and visit the tenant.

If in operation 308, it is determined that the tenant approved of the requested visit, then the method proceeds to operation 310, wherein the non-scheduled visitor is authorized and a digital badge is transmitted to the non-scheduled visitor's cell phone and displayed. Alternatively, the kiosk itself can print a badge for the non-scheduled visitor in which the non-scheduled visitor would take (and optionally wear on his shirt). The badge would contain indicia (e.g., QR code, etc.) identifying the non-scheduled visitor and an authorization code that can be verified by scanning the badge.

From operation 310, the method proceeds to operation 311, wherein the visitor uses the digital badge (obtained in operation 310) to proceed through locked barrier (i.e. door, turnstile, elevator). For example, the kiosk could be in a publicly accessible area in the building, and elevators to the rest of the building could be located behind a turnstile which requires a valid badge in order for a visitor to pass through. The non-scheduled visitor would display his/her badge to a camera on or near the turnstile while would scan the badge, confirm that the authorization code therein is valid and that the current time is consistent with the authorization code, and then release the turnstile so that the non-scheduled visitor can enter.

In a further embodiment, a visitor has made an appointment with a tenant (a "scheduled visitor"). This visitor is processed differently than the non-scheduled visitor described in FIG. 3.

Figure 4:
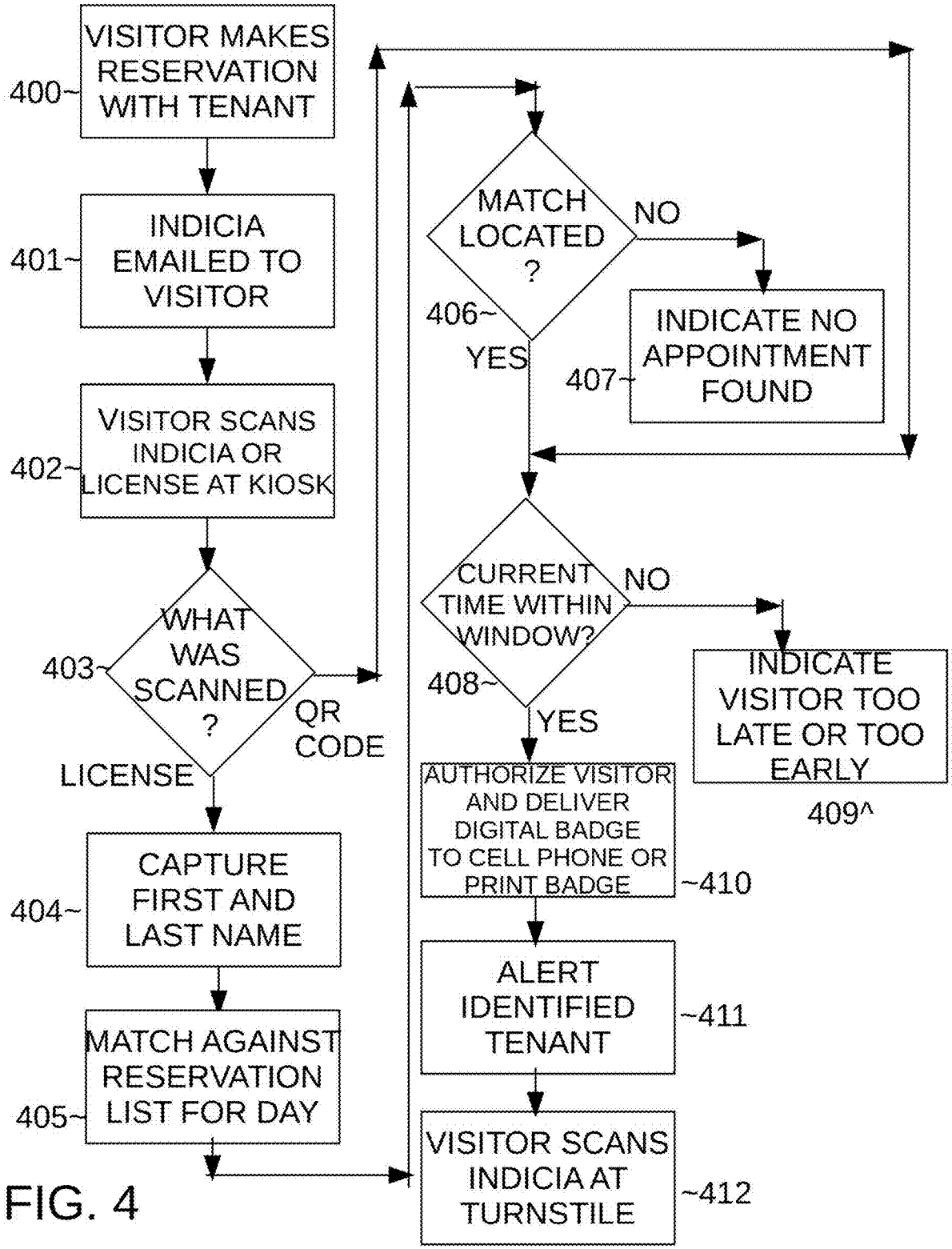
FIG. 4 is a flowchart illustrating an exemplary method of processing a scheduled visitor, according to an embodiment.

FIG. 4 is a flowchart illustrating an exemplary method of processing a scheduled visitor with no touch contact, according to an embodiment.

The method can begin with operation 400, wherein a visitor makes a reservation with a tenant. This can be done in numerous ways, either using an automatic scheduling system or by manually making the appointment with the tenant. For example, the visitor can call the tenant and schedule a visit with the tenant at a mutually agreeable time and date. Then, the tenant can enter the appointment into a scheduling system that is connected to a server that interfaces the kiosk. The appointment includes the visitor's name (first, last), company affiliation, cell number, email address, start date & time and end date and time of appointment, and the tenant. The visitor becomes a "scheduled visitor" because he/she now has an appointment with a tenant.

From operation 400, the method proceeds to operation 401, wherein an indicia (e.g., QR code, etc.) is emailed (or texted to the visitor's cell phone, etc.) to the scheduled visitor along with a confirmation of the date, time, and tenant name for the appointment.

From operation 401, the method proceeds to operation 402, wherein the scheduled visitor physically presents himself/herself at the kiosk in the building (typically in the lobby) where the tenant whom he/she has the appointment with is located. The scheduled visitor now presents his/her indicia (e.g., QR code) at the kiosk and places it (e.g., the cell phone displaying the indicia) under/in front of a camera (or scanner) on the kiosk so that the kiosk can scan (take a digital image) of the indicia. The kiosk will capture the indicia (e.g., QR code) and then decode it into a text string (or other record locator) which locate a record in the scheduling system/database. If the scheduled visitor scanned a QR code (or other indicia), then the method proceeds to operation 406. In another embodiment, the scheduled visitor can scan his/her license at the kiosk.

If in operation 403, the scheduled visitor scanned his/her license, then the kiosk would use the barcode to decode the first and last name from the license (or alternatively use optical character recognition to capture this information).

From operation 405, the method proceeds to operation 406, wherein the server implementing the method (could be located inside the kiosk or at a remote location) matches the name against a reservation list for that day.

From operation 405 or 403, the method proceeds to operation 406, which determines whether a match was located (using either the license or the indicia). A match means the scheduled visitor's record was found in the database and the appointment is confirmed. Lack of a math means no such record was found and thus this particular visitor cannot be authorized.

If in operation 406, no match is found, then the method proceeds to operation 407, which indicates to the visitor that no appointment is found. This can be done by emailing and/or texting the visitor this information. At this point, the visitor can still attempt to visit the tenant by starting at operation 300 and attempting a non-scheduled visit.

If in operation 406, a match is located for the scheduled visitor, then the method proceeds to operation 408, which determines whether the current time is within a time window. A time window could be defined by the system operators or the tenant. For example, a valid time window could be if the scheduled visitor shows up the proper day of his appointment and within a two-hour (or other predetermined amount) range of the time of the appointment.

If in operation 408, the scheduled visitor is too early or too late, then in operation 409, a message can be texted and/or emailed and/or displayed to the scheduled visitor indicating that he/she missed the scheduled appointment. If the scheduled visitor is too early (arrives at least predetermined amount of time (e.g., 30 minutes) before the scheduled appointment, a message to this effect can be displayed but the method can proceed to operation 410 which would still generate a badge, however it would not be active until the appropriate time (in operation 504) the current time is checked to see if compatible (within a predetermined range of the scheduled time) before the access is allowed in operation 505. if the scheduled visitor is too late (arrives a predetermined amount of time past the scheduled appointment time such as 90 minutes), then a message to this effect will be displayed and the scheduled visitor will not receive a badge. However, the scheduled visitor is now free to attempt to visit as a non-scheduled visitor (e.g., FIG. 3).

If in operation 408, the scheduled visitor is present within the time window, then the method proceeds to operation 410, which authorizes the visitor and delivers a digital badge to the scheduled visitor's call phone. Alternatively, the kiosk can print out a badge at the kiosk itself. The badge can include indicia (e.g., a QR code or other indicia) which can be used to gain entrance past the turnstiles.

From operation 410, the method proceeds to operation 411, which alerts the tenant which has the appointment with the scheduled visitor. In an embodiment, additional information can be transmitted to the tenant (e.g., by email), such as a picture taken of the scheduled visitor at the kiosk, his temperate (a temperature taking device can be located on the kiosk), etc. Note that the alert to the tenant in operation 411 can alternatively be performed after operation 412 (assuming the badge is approved and entry is granted), instead of before operation 412.

From operation 411, the method proceeds to operation 412, wherein the visitor proceeds to the turnstile to scan his/her badge (transmitted or printed in operation 410) so that the visitor can then proceed past the turnstile (or other entry point). If the visitor has a digital badge, then the visitor would display the badge on his/her cell phone and scan the display of the cell phone to the camera/scanner at the turnstile. If the visitor has a physically printed badge, then the visitor would present the printout of the badge to the camera/scanner at the turnstile. Note that the badge presented (scanned) at the scanner/camera at the turnstile in operation 412 still must be confirmed by the system (e.g., authorization server or other server) before entry is granted. The confirmation both confirms the record (number embedded in the indicia) is correct as well as the time is consistent with the appointment. See operations 502-507 for how the badge (once scanned at the turnstile) can be processed to either allow or deny the visitor physical entry past the turnstile (or other barrier).

In a further embodiment, a scheduled visitor who receives an indicia electronically (e.g., email, text, etc.) can use that indicia as a badge, thereby simplifying the process.

Figure 5:
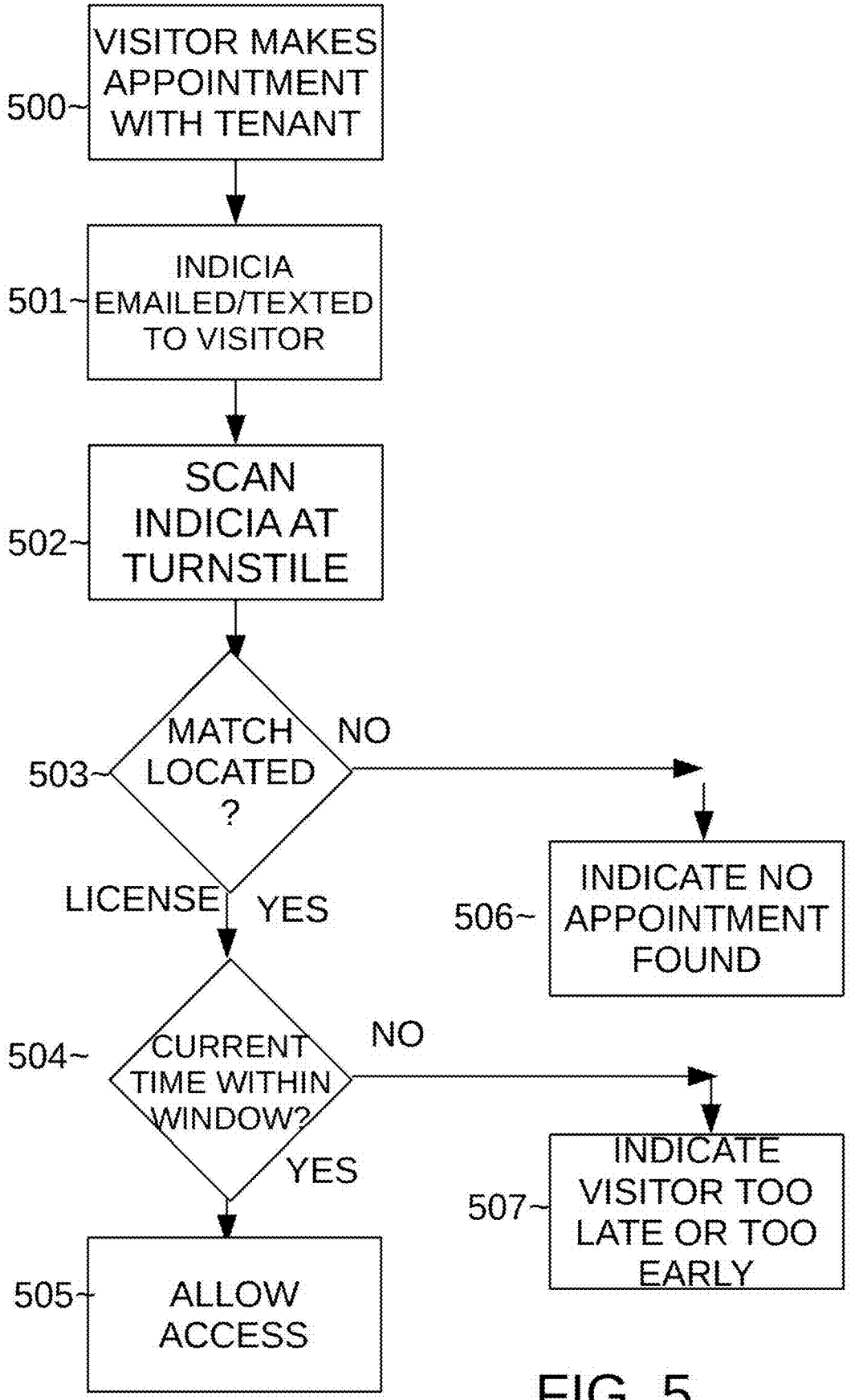
FIG. 5 is a flowchart of an alternate method of processing a scheduled visitor touchless, according to an embodiment.

FIG. 5 is a flowchart of an alternate method of processing a scheduled visitor touchless, according to an embodiment;

In operation 500, the visitor makes an appointment with a tenant he/she wishes to visit in the building. This can be done as described herein.

From operation 500, the method proceeds to operation 501, wherein indicia (any indicia as described herein) is emailed to the visitor (or texted to the visitor's cell phone or transmitted using any other mechanism) to the visitor.

From operation 501, the method proceeds to operation 502, wherein the visitor physically visits the building lobby and proceeds to the turnstile which has a physical barrier to entering the rest of the building. The system must verify that a visitor is authorized to enter the remaining part of the building, and then the system can physically open/unlock the barrier (e.g., a rotating turnstile) in order to enable the visitor to enter. The visitor physically shows/scans the indicia/badge that the visitor received in operation 501 to a camera/scanner at the turnstile.

From operation 502, the method proceeds to operation 503, which determines whether a match is located for the indicia/badge scanned in operation 502. The indicia (e.g., a QR code) that was scanned is decoded into a record locator. The record associated the record locator is retrieved. If the record locator is invalid, then the method proceeds to operation 506, wherein a message is displayed on an output device near the turnstile which states that the indicia/badge that was scanned is invalid and the turnstile is not opened. This message can also be transmitted to the visitor (e.g., texted or emailed). In other words, if a valid match is located (i.e., a record) corresponding to the scanned indicia, then the indicia is authorized (meaning the indicia at one time represented a valid badge). In a further embodiment, no message would be displayed near the turnstile. If the QR code (or other indicia) is authorized (passes all checks), the turnstile opens, and if the QR code (or other indicia) is not authorized then a simple indicator (e.g., a red light or other indication) lights up to indicate the QR code (or other indicia) is not authorized and the turnstile would not open.

If in operation 503, the record associated with the record locator is found, then it is retrieved. The record would contain information such as the visitor's name (first and last), date and time of the appointment, tenant the visitor wishes to visit, visitor's email, visitor's cell phone number, and any other relevant information. From operation 503, the method proceeds to operation 504, which determines if the current time is within a time window of the scheduled appointment. For example, the visitor should arrive within two hours (or other amount of time) before or after the scheduled time in order to be within the window.

If in operation 504, the current time is not within the window of the scheduled appointment embedded in the record, then the method proceeds to operation 507, which displays a message to the visitor he is too late or too early (in which the visitor can just wait until later and try again). The message can be displayed on an output device associated with the turnstile, and/or can also be displayed via text on the visitor's cell phone and/or emailed to the visitor. In a further embodiment, no such message is displayed to the visitor—either the QR code (or other indicia) is authorized and the turnstile opens, or it is not authorized and a simple indicator light lights up to indicate to the visitor he/she is not authorized to enter and the turnstile remains closed.

From operation 504, if the current time is within the time window from the record, then the visitor showed up during the proper time window for his/her appointment and the method proceeds to operation 505, which allows access to the visitor. For example, a turnstile could release a lock on the turnstile to allow the visitor to pass through.

Note that in an embodiment, the turnstile apparatus can itself have access to the database and check the records for authorization as described herein. In a further embodiment, the kiosk 901 (or other system) would transmit QR codes (or other indicia) to the turnstile (along with times in which the QR code or other indicia is valid) and the turnstile would operate as a "local" system. That is, upon scan of a QR code (or other indicia), the turnstile would simply check the current day's activate QR codes (or other indicia) to see if a scanned QR code is valid and the current time is within the time window of the QR code. The turnstile can maintain a simple temporary memory in order to receive and store validated QR codes (or other indicia), along with any other relevant information such as the time window that such QR code is valid, as they are transmitted from the kiosk 901. Once a QR code (or other indicia) is utilized and the turnstile opens, then that QR code (or other indicia) is then removed from the temporary memory. The temporary memory can be flushed (erased) periodically, for example, every day at midnight.

Note that in FIG. 4, there is a two-step process, in which the visitor first receives a (first) indicia that is scanned at the kiosk and then upon confirmation of that indicia, a (second) indicia is then texted to the visitor's cell phone which is used (scanned) at the turnstiles. Note that the first indicia cannot be used at the turnstiles. In another embodiment (shown in FIG. 5) there is a one-step process, in which the indicia transmitted to the visitor can be directly used (scanned) at the turnstile.

Figure 6:
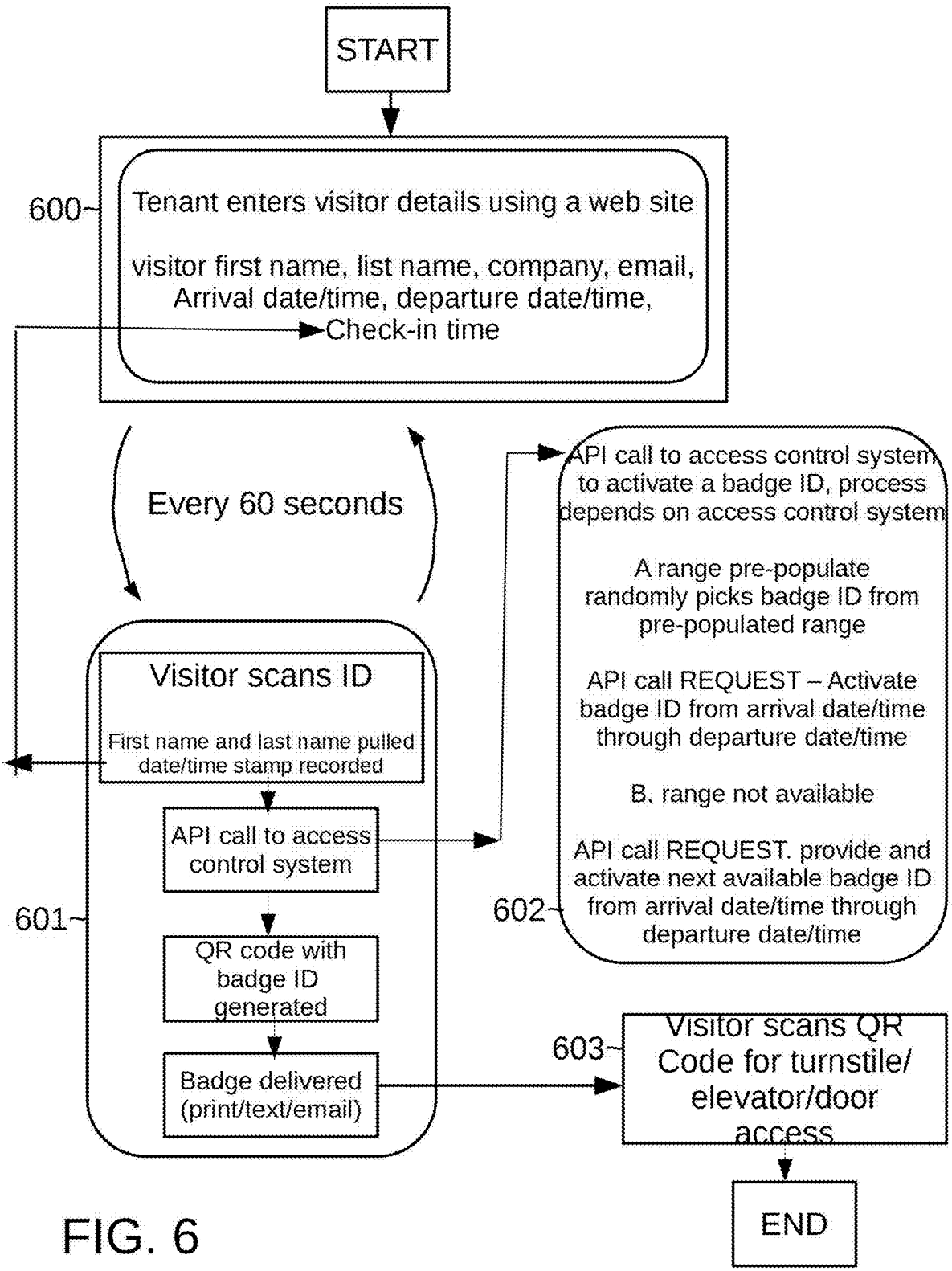
FIG. 6 is a data flow diagram illustrating a workflow of different components in the system, according to an embodiment.

FIG. 6 is a data flow diagram illustrating a workflow of different components in the system, according to an embodiment. Shown is just one example workflow, although it can be appreciated that other workflows can be implemented as well.

A tenant's computer 600, a kiosk 601, a server 602, and a turnstile 603 all communicate with each other (typically using the Internet) in order to accomplish the methods described herein.

A tenant in the building can schedule an appointment with a visitor, and then enter that appointment into a web-based scheduling system using a web browser on their computer 600. The tenant can enter the visitor's first name, last name, company name, email address, cell phone number, arrival and departure times, and check-in time (time the visitor should check in at a kiosk in the building lobby). The web site can be hosted by a web server which transmits the relevant data to a scheduling server which maintains all of the scheduling records for the building. Typically, the servers are not located in the building but are all accessed via the internet, although the servers can be located anywhere. The scheduling server would typically service multiple buildings.

Periodically (e.g., every 60 seconds), the database available to the kiosk 601 is updated so the latest scheduling records are available to the kiosk. A visitor scans his/her license, and the visitor's first name, list name is pulled from the license (either using optical character recognition or decoded from a barcode on the back of the license0. The time and date of the scan is also recorded.

Then, an Application Programming Interface (API) calls a server function on an authorization server 602 in order to generate a badge for the visitor. Each badge would have an identification (ID) number that would be unique for the time period (e.g., each week (or month, year, etc.) no two badges would have the same ID number). The function would generate and return the badge ID number which is needed for entry into the building. Note that the scheduling server can be the same server as the authorization sever or they can be two separate servers (in the same or different locations). Note that the barrier 702 can be a separate system (operated by a separate party) that is interfaced with the server 904. The server 904 (which generates QR codes or other indicia) can communicate valid QR codes (or other indicia) to the processing unit 700 controlling the barrier 702 and/or a server (connected to the internet) that interfaces with the processing unit 700 and hence programs the processing unit 700 to enable access (e.g., open the barrier 702) upon presentation of particular QR codes (or other indicia) within a respective time window.

The kiosk 601, once receiving the badge ID from the server API call, which generate a badge (for example, generate a QR code (o rother indicia) encoding the badge ID number). The kiosk 601 then would deliver the badge to the visitor, either by physically printing the badge on paper or transmitting an electronic version of the badge to the visitor via email or text message (or other transfer mechanism such as near field communication, etc.)

When the visitor is at the turnstile 603 (a separate apparatus from the kiosk), the visitor then presents his/her badge which would then release (open) the turnstile so that the visitor can pass through. Instead of a turnstile, a physical door (or other barrier) can be used which would be locked until a valid badge is presented which would then unlock the barrier allowing the visitor to proceed through. Instead of a turnstile, elevator access can be granted using the same procedure. For example, an elevator door would not open for the visitor until the visitor presented his/her badge (which must be authorized first). Alternatively, a visitor can enter an elevator, but cannot press an elevator button (which causes the elevator to stop at a particular floor) until the visitor presents his/her badge.

Figure 7:
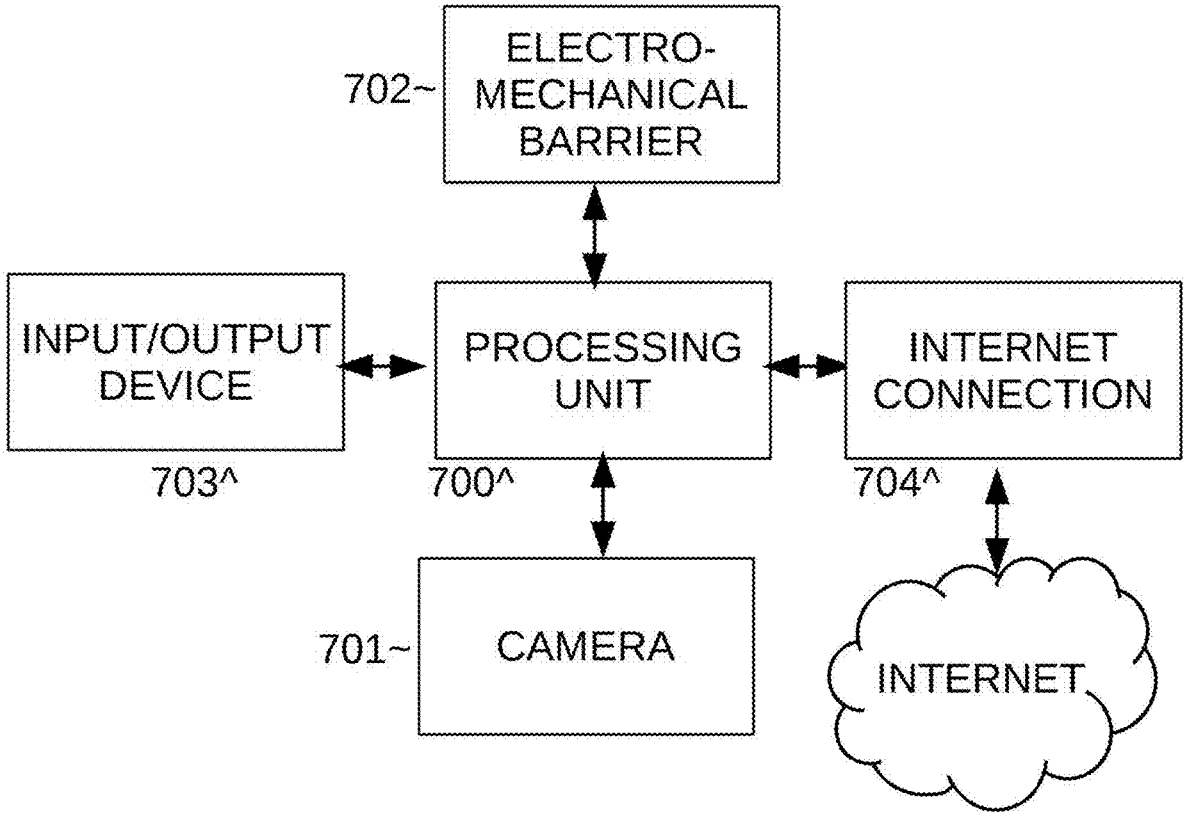
FIG. 7 is a block diagram illustrating a turnstile structure, according to an embodiment.

FIG. 7 is a block diagram illustrating a turnstile structure, according to an embodiment.

A processing unit 700 can be a microprocessor (and any associated structure, such as power supply, bus, cache, ROM, RAM, non-transitory storage, etc.) The processing unit 700 is connected to an electronic input/output device 703 (e.g., a touch screen). The processing unit 700 is also connected to a camera/scanner 701 (a "barrier camera" or "barrier scanner") which can scan physical items (typically in 2-dimensions, such as a license or QR code) near the turnstiles (e.g., the camera 701 can be within 10 feet of the barrier 702). Also note that the barrier camera 701 is a different physical camera than the kiosk camera 801 which typically not even be close to each other. The processing unit 700 is also connected to an electro-mechanical barrier 702 (e.g., a turnstile, door, elevator control, etc.) and can control whether it opens or remains closed/locked. The processing unit 700 is also connected to an internet connection 704 which enables the processing unit 700 to both send and receive information/data with other computers across the internet.

Note that the processing unit 700 can read (from a non-transitory storage such as a memory chip, disk drive, etc.) and execute computer readable instructions to perform any of the features described herein (or not described but needed) that the turnstile apparatus performs. This includes initiating the scanner and decoding the scanned image, determining whether the badge scanned is authorized, releasing (opening) the electro-mechanical barrier 702 if authorized, displaying messages on the input/output device 703, etc.

Figure 8:
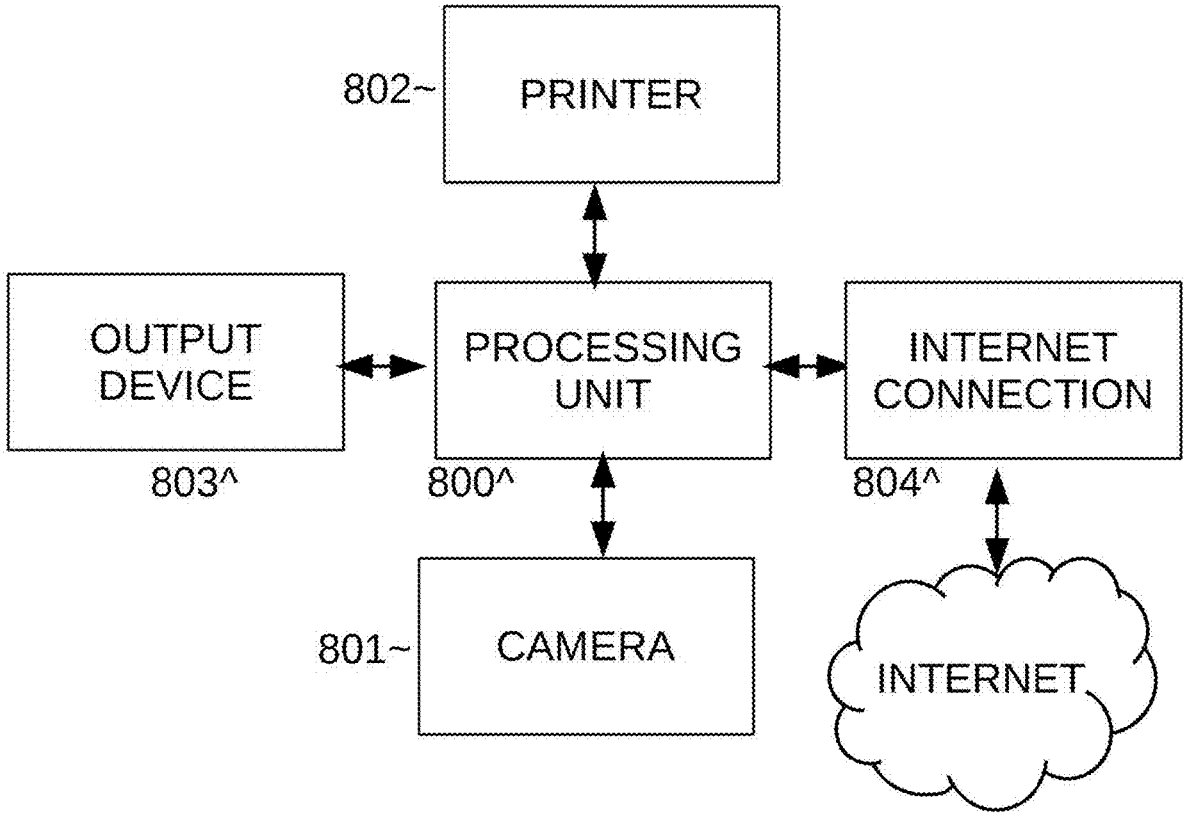
FIG. 8 is a block diagram illustrating a kiosk structure, according to an embodiment.

FIG. 8 is a block diagram illustrating a kiosk structure, according to an embodiment.

A processing unit 800 can be a microprocessor (and any associated structure, such as power supply, bus, cache, ROM, RAM, non-transitory storage, etc.) The processing unit 800 is connected to an electronic input/output device 803 (e.g., a touch screen). The processing unit 800 is also connected to a camera/scanner 801 (a "kiosk camera" or "kiosk scanner") which can scan physical items (typically in 2-dimensions, such as a license or QR code). The processing unit 800 is also connected to a printer 802 which can print badges on paper. The processing unit 700 is also connected to an internet connection 704 which enables the processing unit 700 to both send and receive information/data with other computers across the internet. Note the camera 801, printer 802, and output device 803 can all be physically embedded on the kiosk.

Note that the processing unit 700 can read (from a non-transitory storage such as a memory chip, disk drive, etc.) and execute computer readable instructions to perform any of the features described herein (or not described but needed) that the kiosk performs. This includes initiating the scanner and scanning a license or indicia, printing a badge, communicating with the scheduling server to determine whether the visitor is authorized, communicating with the authorization server to receive a badge ID, displaying messages on the input/output device 803, etc.

Figure 9:
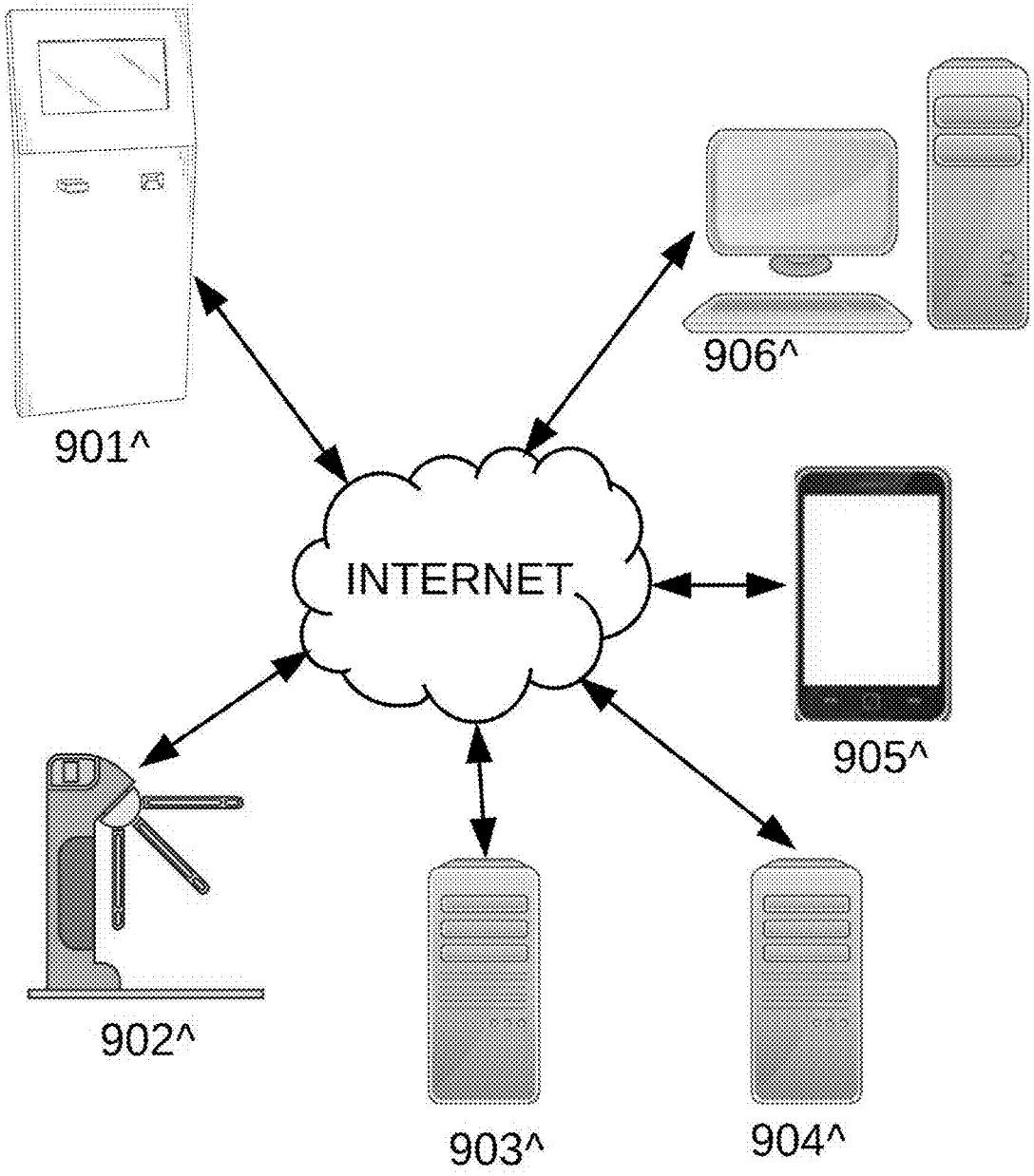
FIG. 9 is a network diagram illustrating components on the system, according an embodiment.

FIG. 9 is a network diagram illustrating components on the system, according an embodiment. This represents just one possible example. The components of the system can all communicate with each other via the internet (or other computer communications network).

A kiosk 901 and a turnstile 902 are at the same building. Note that a building can have multiple kiosks 901 with the same structure/function. While a turnstile 902 is shown, in place of a turnstile, an apparatus with other functionality can be used, such as a door, elevator access, etc. A tenant computer 906 is used by the tenant to enter an appointment scheduled with a visitor (see operations 400, 500, or any other operation involving the tenant). A visitor's cell phone 905 is used by the visitor to interact with the system as described herein, receive badges (indicia), etc. A web server 903 can serve any web site used by the system herein (for example, the web site used by the tenant to enter scheduled appointments, the web site used by the visitor to browse the tenant list and request an appointment with a tenant, etc.) A system server 904 can be a single or multiple servers operating together and can comprise the scheduling server, the authorization server, etc. In other words, the system server 904 can be the server (computer) which can be programed to implement, and actually implements, all of the functionality herein to carry out the system.

For example, the kiosk 902 would communicate with the authorization server (which can be part of the system server 904) and transmit a badge ID and receive a signal from the authorization server whether the visitor should be allowed access (in which the turnstile or other such structure is opened) or not (in which the turnstile or other such structure remains closed). The system server 904 can store all communications and records.

Some functionalities can be processed at different parts of the system. For example, when a visitor presents their license to the kiosk 901, the validation of the license (e.g., checking to see whether the owner has a valid appointment that day/time) can be performed by the processing unit 800 on the kiosk 901 (by querying to see if that person has a schedule record for that day/time) or by the system server 904 (by querying to see if that person has a schedule record for that day/time). All components to the system can communicate with each other any data used by the system without limitation.

FIG. 10 is a sample output on an electronic output device associated with a kiosk, according to an embodiment.

When a visitor first walks up to a kiosk, he/she can be presented with a default screen such as illustrated in FIG. 10. A scheduled visitor can scan a QR code (or other indicia) he may have on his/her cell phone to check in and receive a badge (printed at the kiosk or thereafter texted/emailed), or a non-scheduled visitor can scan his/her driver's license at the kiosk to begin the process of scheduling an appointment. The visitor can also scan the QR displayed on the visitor's cell phone if the visitor wishes to browse the tenant list with no touch contact (for example by using the visitor's cell phone to browse the tenant list).

Figure 11:
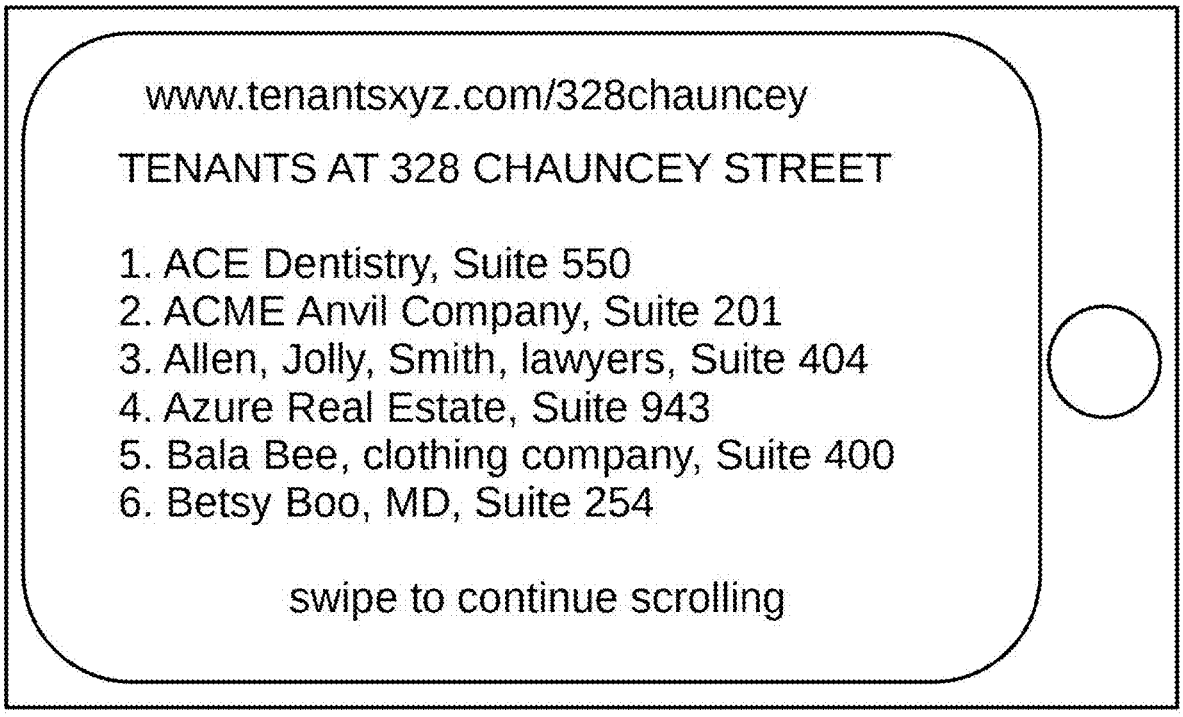
FIG. 11 is a sample output of a cell phone browsing a tenant list of a building, according to an embodiment.

FIG. 11 is a sample output of a cell phone browsing a tenant list of a building, according to an embodiment.

In operation, the visitor can scan (operation 200) the QR code shown on the kiosk output device (e.g., in FIG. 10) and the QR code can be decoded into a web address (URL) which can then bring up and display (operation 201) the tenant list on the visitor's cell phone which the visitor can scroll through (operation 202). Note that the visitor does not have to physically touch the kiosk in any way to retrieve this information.

Figure 12:
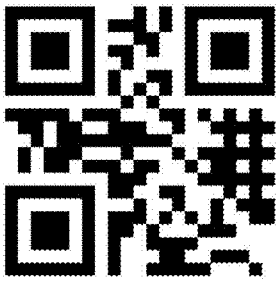
FIG. 12 is a sample output on an electronic output device associated with a kiosk prompting to scan a QR code, according to an embodiment.

FIG. 12 is a sample output on an electronic output device associated with a kiosk prompting to scan a QR code, according to an embodiment.

The visitor scans his/her license at the kiosk (operation 300) and the visitor's name has been captured. A QR code (or other indicia) is displayed (operation 302) on the kiosk output device which should be scanned by the visitor (operation 303).

Figure 13:
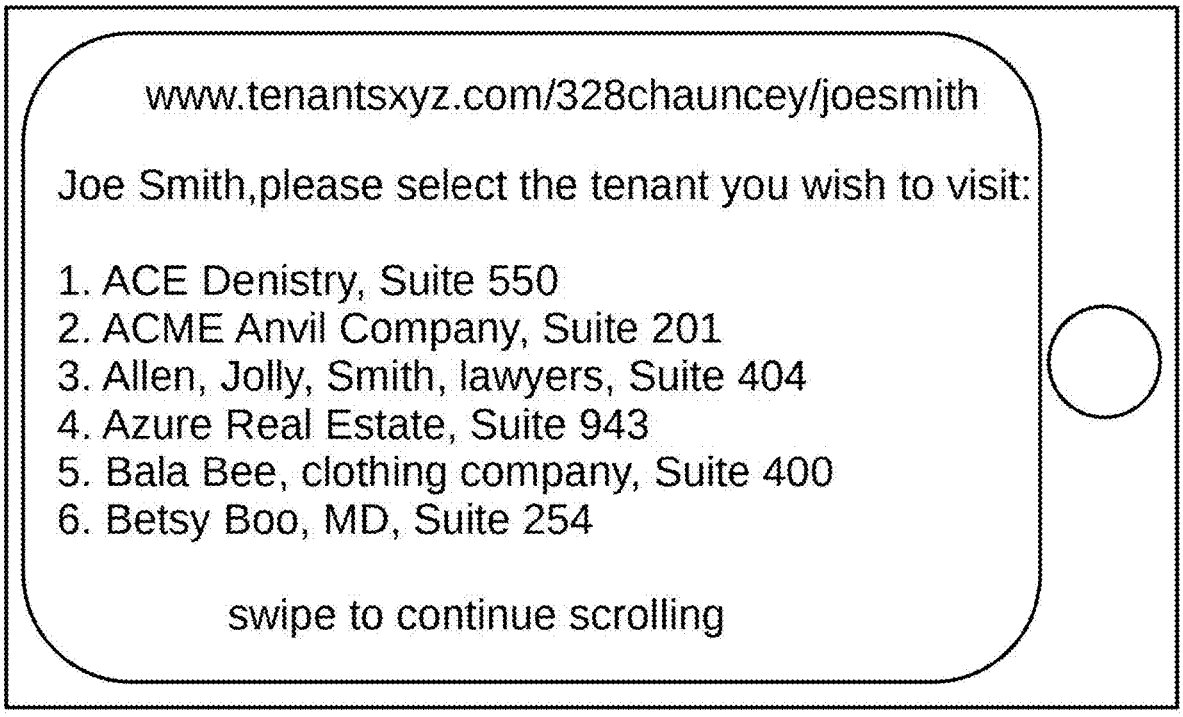
FIG. 13 is a sample output on a cell phone prompting the visitor to select which tenant the visitor wishes to visit, according to an embodiment.

FIG. 13 is a sample output on a cell phone prompting the visitor to select which tenant the visitor wishes to visit, according to an embodiment.

After scanning the QR code displayed on the kiosk output device (operation 303), the QR code is decoded into a URL (uniform resource locator) and a web page corresponding to the URL is opened on the cell phone (operation 304). This displays the tenant list which the visitor can scroll through until he/she finds a tenant he/she wishes to visit at that time without having made an earlier appointment.

Figure 14:
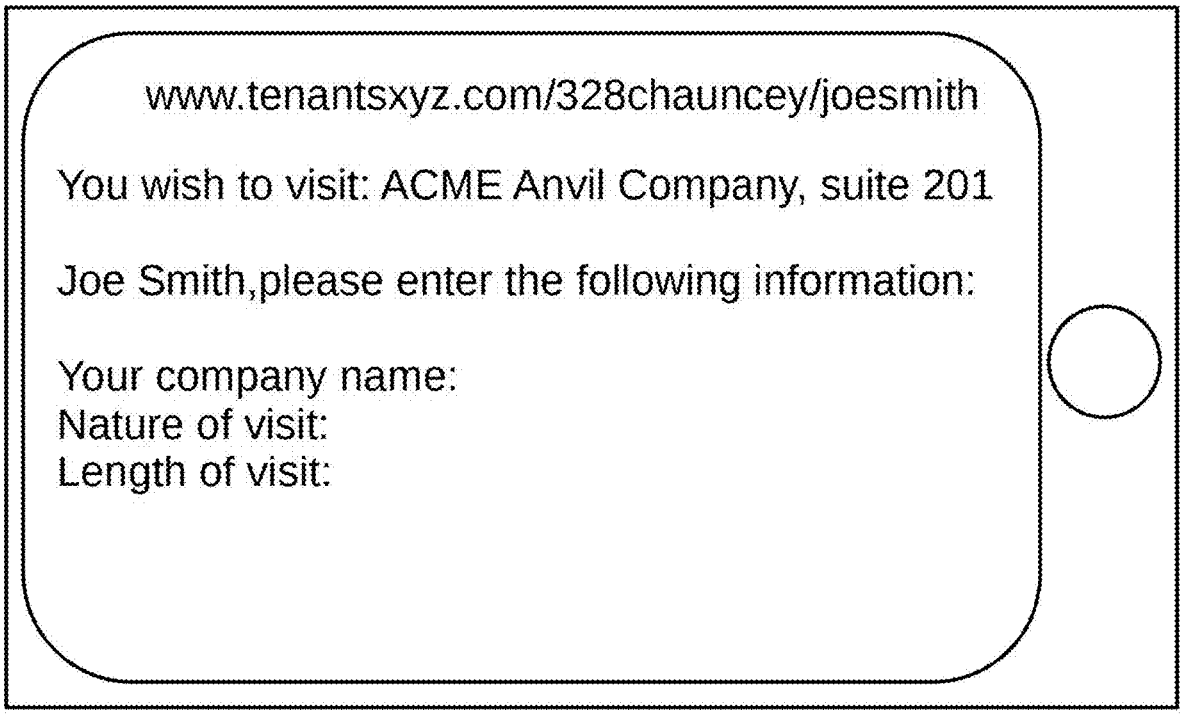
FIG. 14 is a sample output on a cell phone prompting the visitor to enter his/her visit information, according to an embodiment.

FIG. 14 is a sample output on a cell phone prompting the visitor to enter his/her visit information, according to an embodiment.

The visitor touched (selected) a particular tenant on the list on his/her cell phone. The visitor is now prompted to enter information (operation 306) about his/her requested visit.

Figure 15:
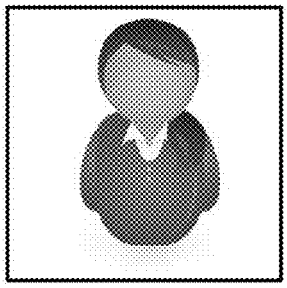
FIG. 15 is sample output on a computer screen on a computer used by a tenant prompting the tenant to approve an instant appointment request, according to an embodiment.

FIG. 15 is sample output on a computer screen on a computer used by a tenant prompting the tenant to approve an instant appointment request, according to an embodiment.

Once the non-scheduled visitor has requested an appointment with the tenant, in an optional feature), the tenant receives a notification/request (operation 307) (via email on the tenant's computer, text on the tenant's cell phone, or other mechanism). The email received can be sent by a scheduling server and can contain URL the tenant would click in order to bring up a web page which presents information about the requested visit and enabling the tenant to approve or decline the requested visit. As an alternative to using a web page, all of the information can be embedded in an email and buttons can be embedded in the email (which each have a web link associated with it when pressed would trigger an action based on the respective button pressed). Note that information can be presented about the non-scheduled visitor, including his name, company, body temperature taken by a no-contact infrared thermometer on the kiosk (or any other type of thermometer) (so the tenant can judge whether the non-scheduled visitor may be not be a welcome visitor due to his/her elevated temperature), his/her stated purpose for the visit, and a picture of the non-scheduled visitor taken by a camera at the kiosk. The picture is stored can be taken by the kiosk camera 801, or alternatively by a different camera located on or near the kiosk. The tenant would press (click) whichever button he/she wishes (operation 308) in order to approve the appointment or decline it. If the tenant approves, then the approve button will trigger (operation 310) a badge being transmitted (e.g., via text) to the non-scheduled visitor's cell phone. If the tenant declines, then the non-scheduled visitor is presented with a notice declining the visitation request (operation 309).

Figure 16:
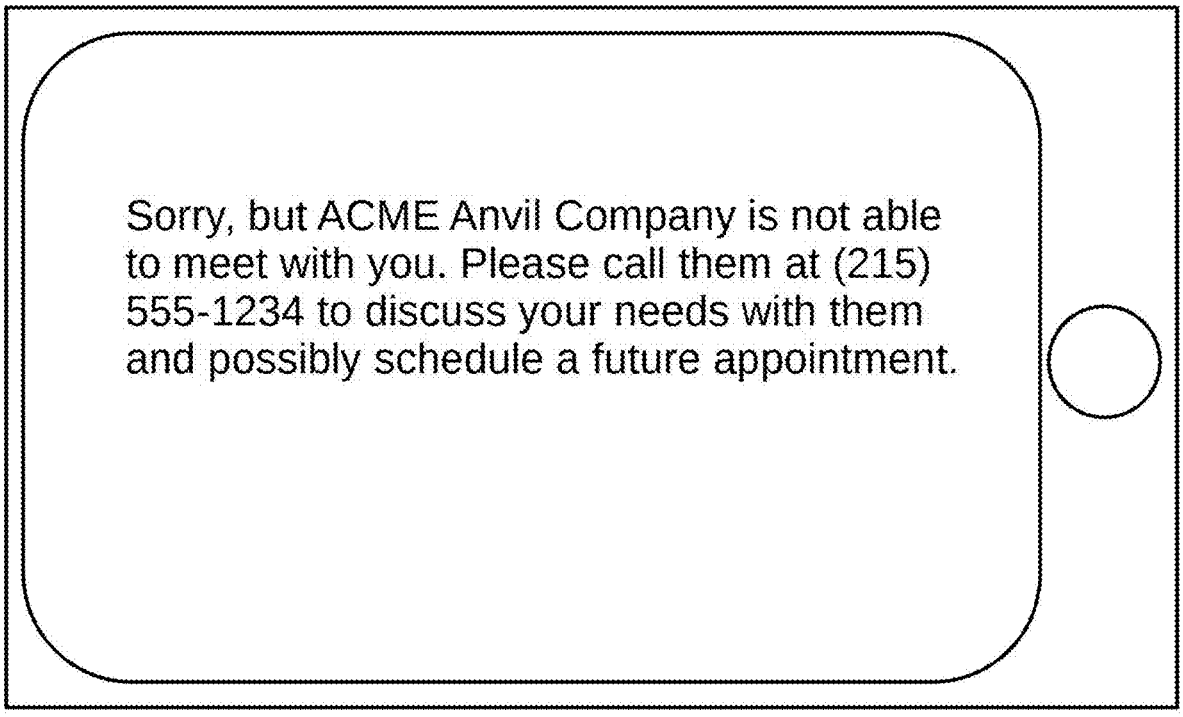
FIG. 16 is a sample output on a cell phone informing the visitor that his/her request for an instant appointment was declined, according to an embodiment.

FIG. 16 is a sample output on a cell phone informing the visitor that his/her request for an instant appointment was declined, according to an embodiment.

In operation 308, the tenant did not approve (declined) the non-scheduled visitor's request, and hence the declination message is displayed (operation 309) on the visitor's cell phone. The message can be displayed via a text message or email.

Figure 17:
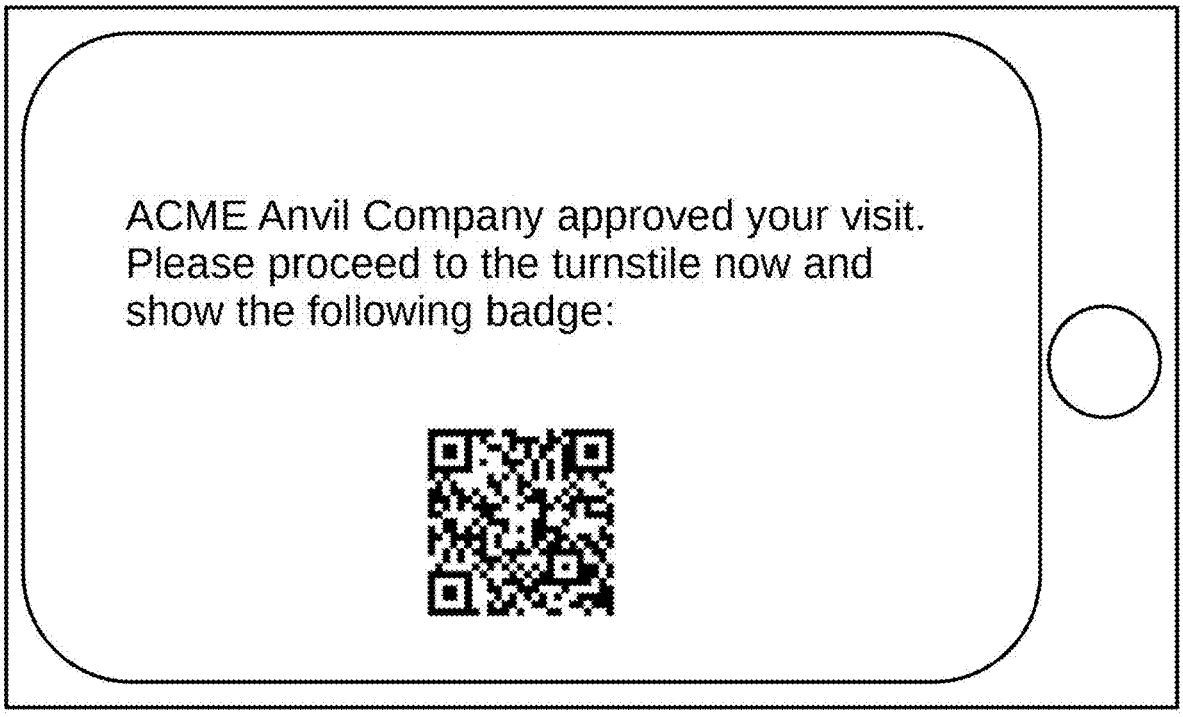
FIG. 17 is a sample output on a cell phone informing the visitor that his/her request for an instant appointment was approved, according to an embodiment.

FIG. 17 is a sample output on a cell phone informing the visitor that his/her request for an instant appointment was approved, according to an embodiment.

In operation 308, the tenant approved of the request for a non-scheduled appointment by the non-scheduled visitor, and hence an authorization message is displayed (operation 310) on the visitor's cell phone (either by email or text). Indicia (such as a QR code) is also displayed which would enable entry to the turnstile (or other barrier). This can be considered a "badge." Note that the non-scheduled visit must present himself/herself at the turnstiles (operation 311) within a predetermined amount of time from receiving this message (e.g., 10 minutes) before the badge expires.

FIG. 18 is a sample output on a computer screen on a computer used by a tenant prompting the tenant to enter appointment information, according to an embodiment.

A tenant and a visitor can schedule an appointment together (e.g., via a telephone call) (operation 400), and the appointment information can be entered by the tenant into a scheduling system as shown in FIG. 18. The scheduling system can interface with the scheduling server (although any other service can be used) and can be web based. The tenant would type in the relevant information (e.g., visitor's name, company, email address, cell phone number, date and time of appointment, etc.)

Figure 19:
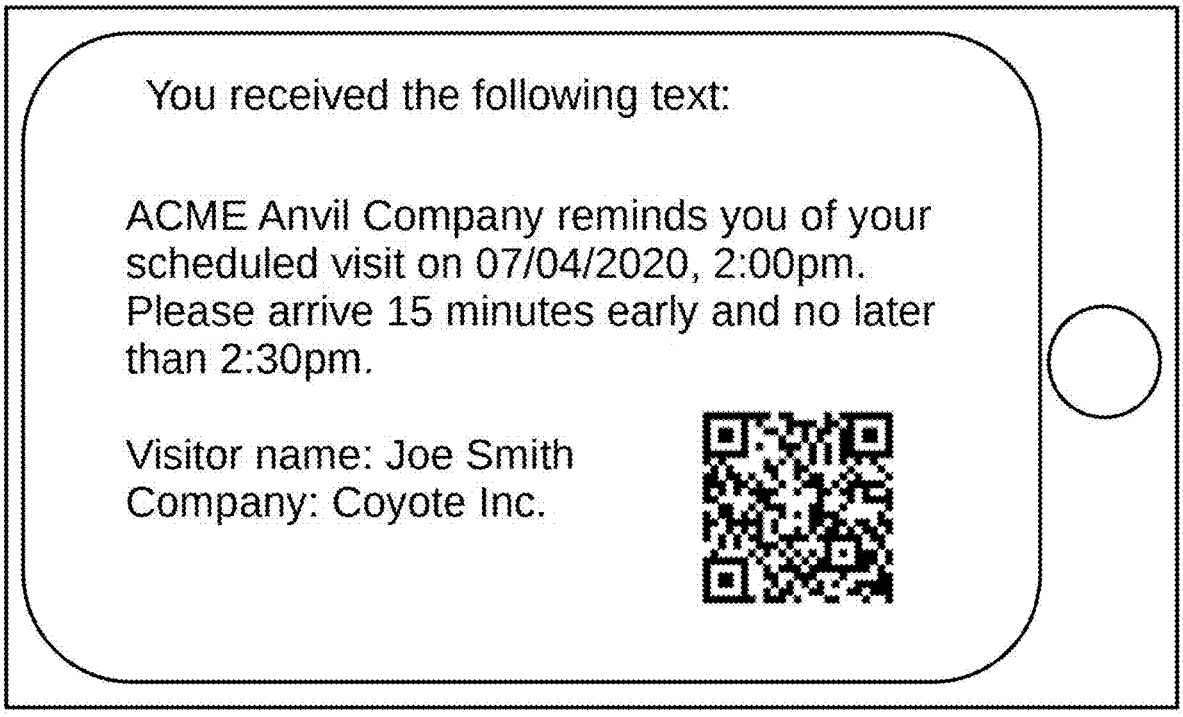
FIG. 19 is a sample output on a visitor's cell phone showing a confirmation screen, according to an embodiment.

FIG. 19 is a sample output on a visitor's cell phone showing a confirmation screen, according to an embodiment.

In operation 401, indicia (e.g., a QR code) is transmitted (email, text, etc.) to the scheduled visitor's cell phone, which can be scanned at the kiosk before the scheduled appointment. Note that in another embodiment (shown in FIG. 5) such indicia (can be a badge) can be scanned directly at the turnstiles (or other barrier) and the kiosk can be skipped. The message (and in fact any message described herein) can be transmitted to the visitor using any mechanism (e.g., email, text, voice, etc.)

FIG. 20 is a sample confirmation output on a kiosk screen, according to an embodiment.

When the scheduled visitor scans (operation 402) their indicia (such as a QR code at the kiosk), then a confirmation screen as shown in FIG. 20 can be displayed on the kiosk output device. Note that the badge texted to the scheduled visitor's cell phone can look similar or the same as the text shown in FIG. 19, which would then be scanned at the turnstile (operation 502). Note that in an embodiment, the tenant is now notified that the visitor is present and on his/her way inside (or up) the building. In another embodiment, the tenant is only notified that the visitor is present when the visitor scans his/her badge at the turnstile (instead of the kiosk).

FIG. 21 is a sample output on a kiosk screen informing the visitor that he/she is too early, according to an embodiment.

If the visitor is too early (arrives a predetermined amount of time before the scheduled time) for his/her appointment (operation 409), the visitor can still receive his/her badge (emailed or texted) but a notice indicating that the visitor must wait until the appropriate time can be displayed before the badge will work at the turnstile. In an alternative embodiment, the visitor would not receive his/her badge if the visitor is too early and the visitor would have to wait until the scheduled time and then present himself/herself at the kiosk again (e.g., scan the indicia or license) to then receive the badge.

FIG. 22 is a sample output on a kiosk screen informing the visitor that he/she is too late, according to an embodiment.

If the scheduled visitor arrives too late (arrives a predetermined amount of time past the scheduled time) (see operation 409), then such a notice can be displayed on the kiosk as shown in FIG. 22. The visitor is still able to attempt to gain access to the building and visit the tenant by following the procedure for a non-scheduled visitor (in FIG. 3).

Figure 23:
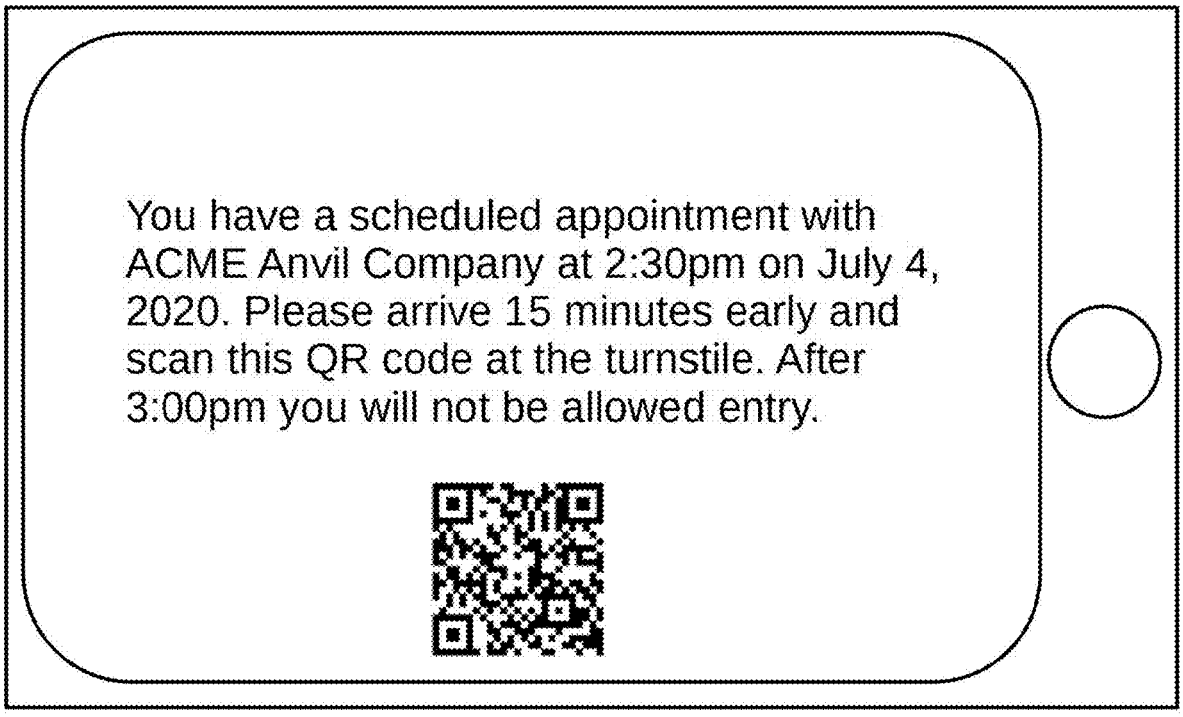
FIG. 23 is a sample output on a visitor's cell phone showing a badge, according to an embodiment.

FIG. 23 is a sample output on a visitor's cell phone showing a badge, according to an embodiment.

If the indicia scanned at the kiosk is verified, that is, passes the match locator (operation 406) and the time check (operation 408) then a badge (as shown in FIG. 23) will be generated and transmitted to the visitor's cell phone (e.g., texted or emailed). Note that the badge (shown in FIG. 23) can also be physically printed as well, and the printout (instead of the cell phone screen) would be scanned at the turnstiles.

Figure 24:
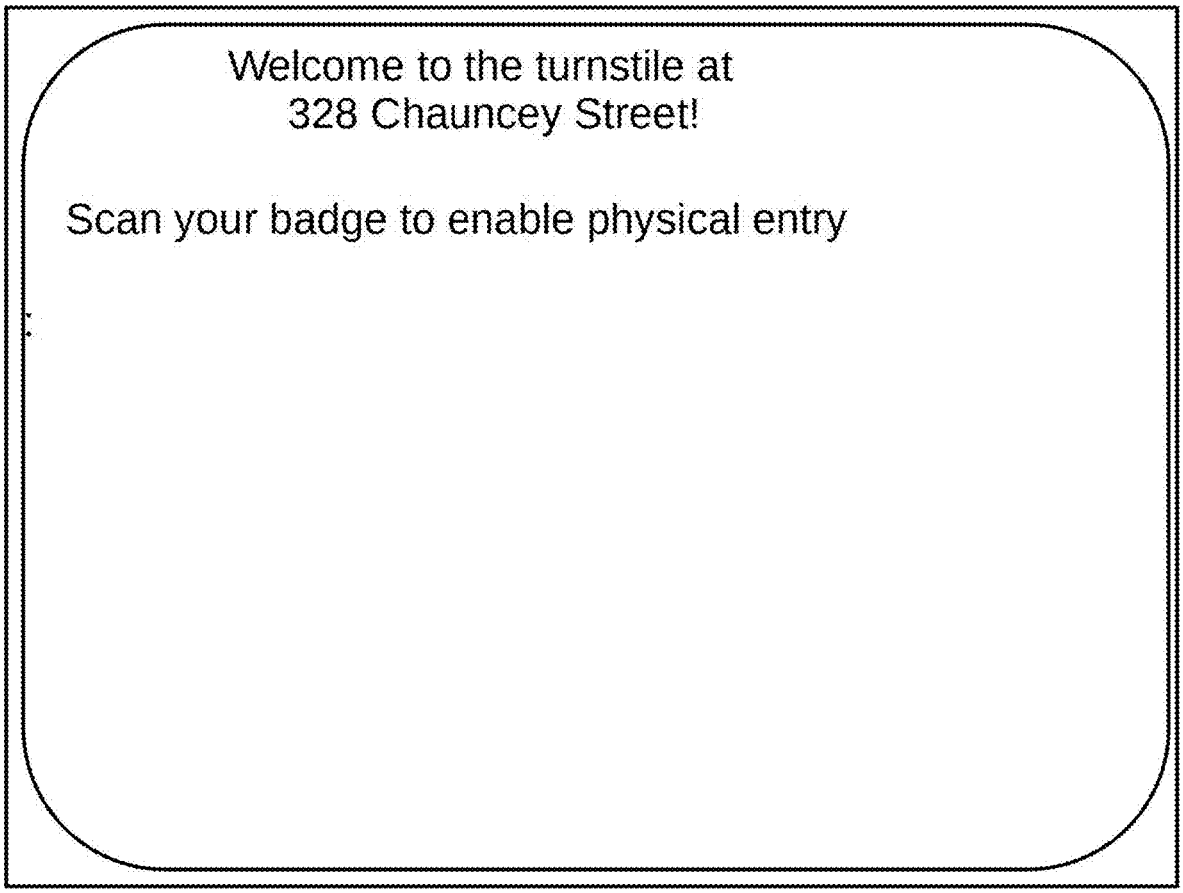
FIG. 24 is a sample output on an output device on a turnstile prompting for scanning of a badge, according to an embodiment.

FIG. 24 is a sample output on an output device on a turnstile prompting for scanning of a badge, according to an embodiment.

At the turnstile, an electronic output device would display messages. A message such as that shown in FIG. 24 can be displayed by default. In an alternative embodiment, there would be no electronic output device that can display messages but there would be an electronic light (and/or audio) which would light up (and optionally sound a tone) if a QR code (or other indicia) was not authorized and the turnstile would not open.

Figure 25:
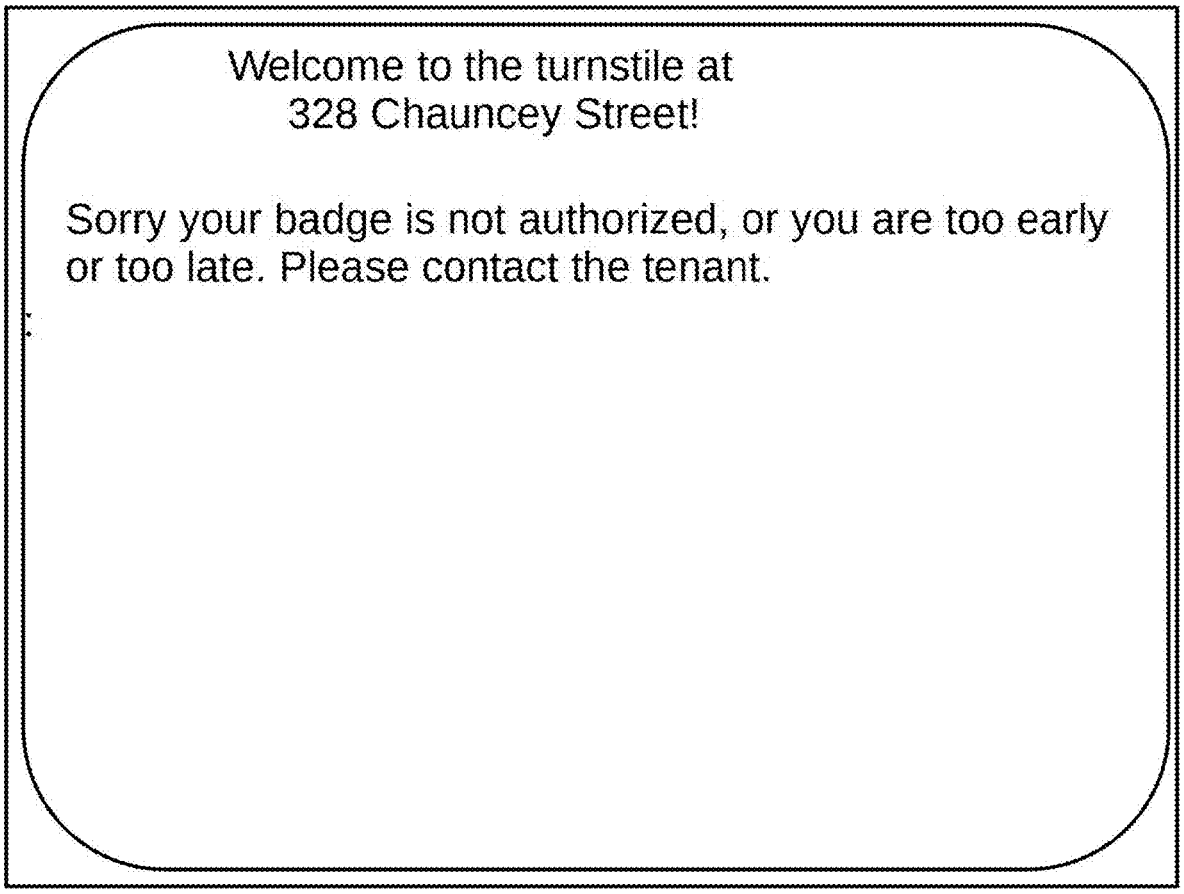
FIG. 25 is a sample output on an output device on a turnstile indicating the badge is not authorized and denying entry, according to an embodiment.

FIG. 25 is a sample output on an output device on a turnstile indicating the badge is not authorized and denying entry, according to an embodiment.

If a badge does not pass the verification check (the QR code or other indicia cannot locate a valid record, or if the record is found the current date and/or current time is not consistent with the time designated in the record for the appointment), then the visitor will not be allowed access and a message such as that displayed in FIG. 25 can be displayed at the turnstile.

Figure 26:
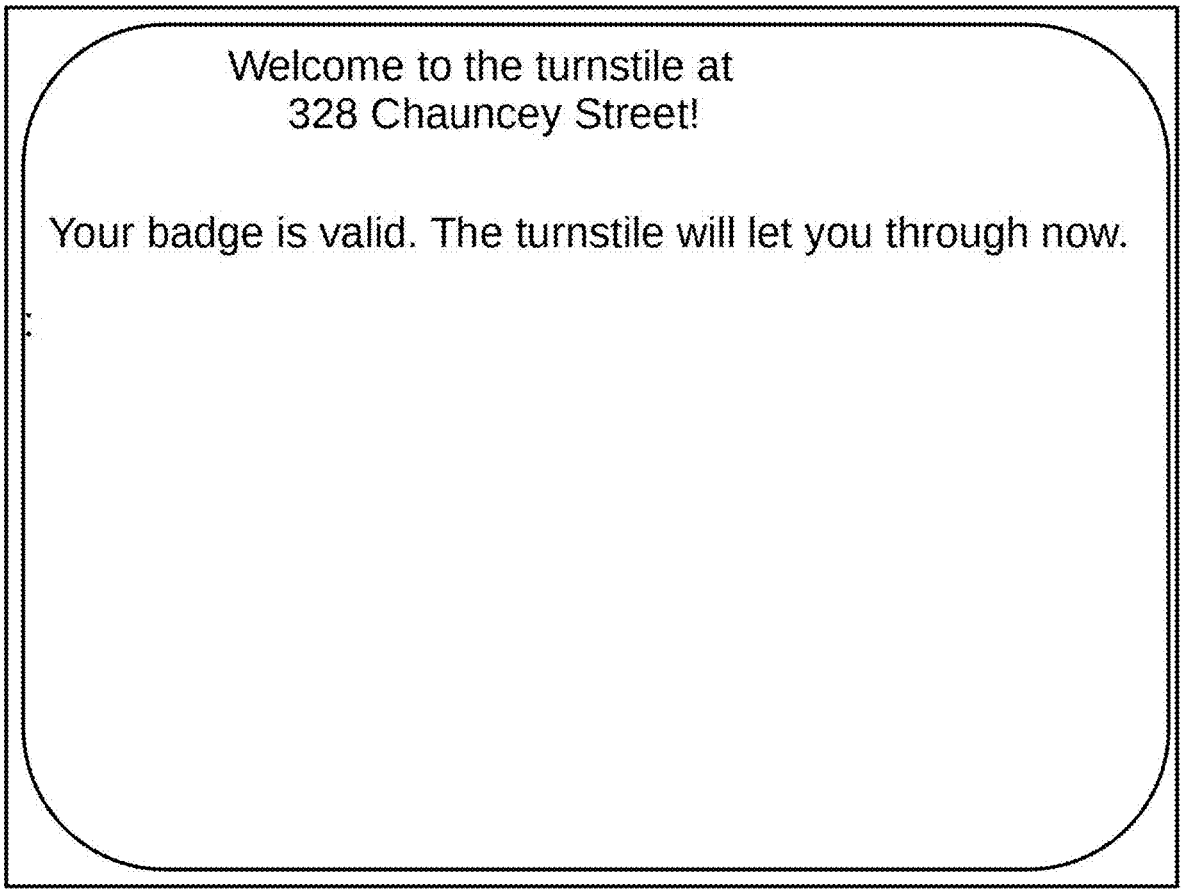
FIG. 26 is a sample output on an output device on a turnstile indicating the badge is valid and unlocking the turnstile for entry, according to an embodiment.

FIG. 26 is a sample output on an output device on a turnstile indicating the badge is valid and unlocking the turnstile for entry, according to an embodiment.

If the badge scanned at the turnstile passes all verifications (e.g., the record identified in the indicia scanned is found, the record is retrieved and the current date is the same as the scheduled appointment (from the record), and the current time is with a predetermined range of time of the scheduled time (from the record)), then the turnstile (or other barrier) can be unlocked/released and the visitor allowed access. In addition to a turnstile, this can be applied to a door, an elevator access to other floors, etc.

Figure 27:
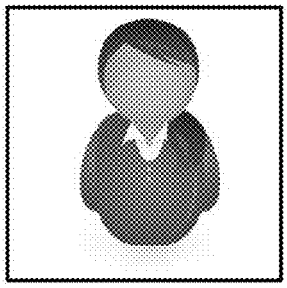
FIG. 27 is a sample output on a computer screen on a computer used by a tenant information the tenant that a visitor is on his/her way to the tenant's office, according to an embodiment.

FIG. 27 is a sample output on a computer screen on a computer used by a tenant information the tenant that a visitor is on his/her way to the tenant's office, according to an embodiment. This output can be delivered to the visitor using any mechanism, such as email, text, web page, etc.

Upon the visitor scanning his/her badge at the kiosk, a notification to the tenant is automatically transmitted to the tenant (typically via email or text). The record identified in the scanned indicia would typically have the tenant's contact information (e.g., email or cell number) which can be used to send the notification. In addition, the record can also have other information (e.g., name, company, etc.), as well as additional information captured from the kiosk (e.g., visitor temperature, picture taken at the kiosk), etc.

In a further optional embodiment, facial recognition can be used to identify visitors. When visitors are in front of a kiosk (at any operation), a picture can be taken of the visitor. If the visitor is then identified (e.g., by the visitor presenting his/her identification), the picture taken at the kiosk can be associated with a record stored in the database which also stores the visitor's identification information (e.g., the license). In addition, the digital image of their identification can also be stored in the record. Thus, the record can contain multiple images of the visitor: from the visitor's identification (e.g., license), and one (or multiple) pictures taken from a camera located on the kiosk (or other such device). Each time the same visitor presents himself/herself in front of a kiosk (or other such device) a picture of the visitor can be taken and added to the visitor's record (if the visitor has no such record then one can be created for him/her). In this way, one or more images can be used to automatically identify a visitor using facial recognition when he/she presents himself/herself in front of a kiosk for an appointment. If the visitor can be recognized, then this can avoid the visitor the inconvenience of having to present his/her identification to the kiosk (or other such device).

Note that in operations 300, 404 (and any other operation that receives a visitor's identification that has a picture on it), the image (e.g., JPG, etc.) of the identification can be stored in a record associated with the visitor. In addition, a picture of the identification holder on the identification itself can be cropped and stored separately so that the picture itself (without any other information/portion of the identification) can be used for facial recognition purposes. Over time, multiple images of the visitor can be accumulated and all such images can be used to train the facial recognition system (e.g., which uses a neural network or other such learning system) to improve the recognition ability of the visitor. In other words, both the image captured from the identification (e.g., license) as well as images captures of the visitor live from the kiosk camera can be used to train the facial recognition system to recognize the visitor.

Figure 28:
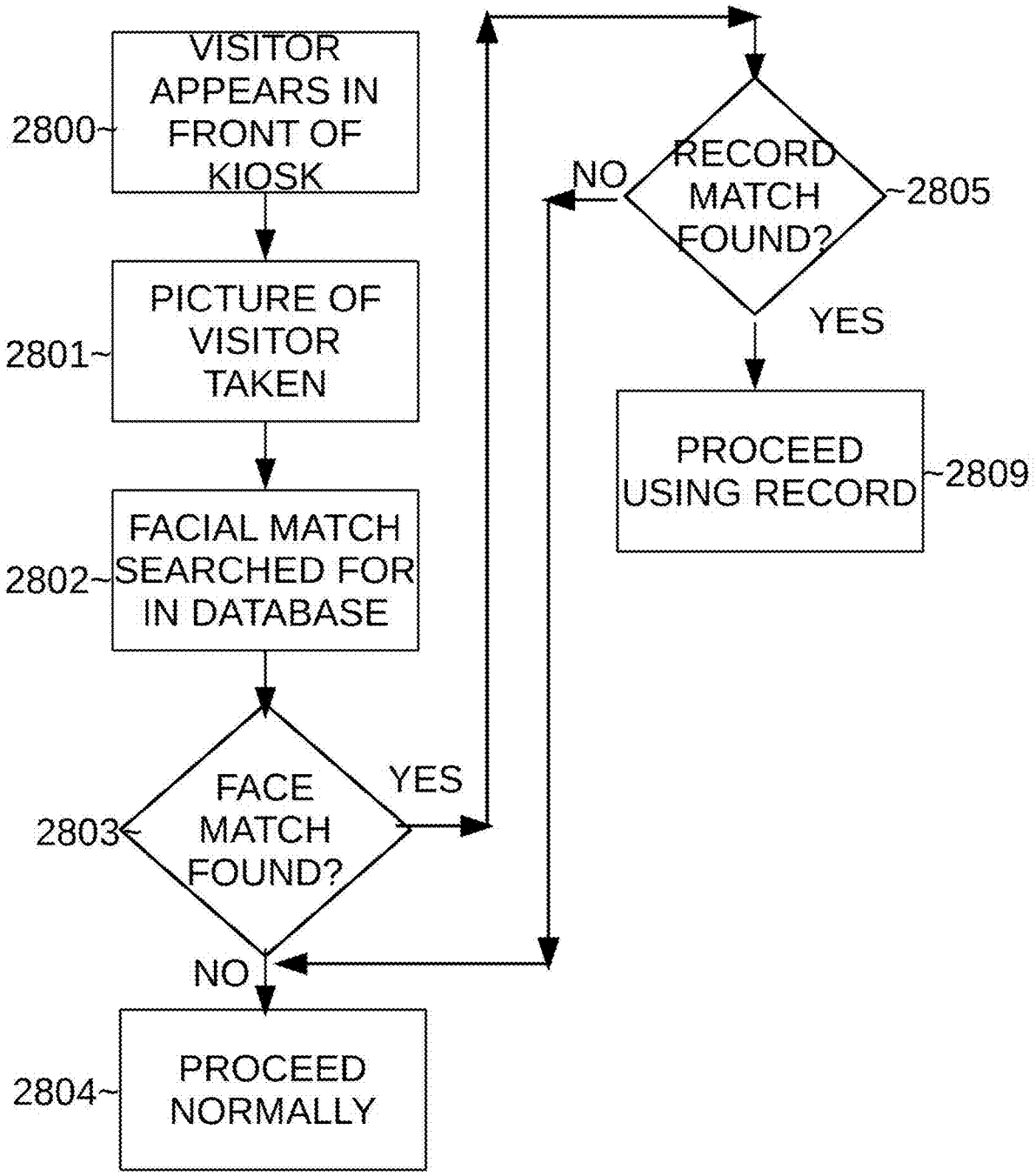
FIG. 28 is a flowchart illustrating an exemplary method of using facial recognition to verify a visitor, according to an embodiment.

FIG. 28 is a flowchart illustrating an exemplary (optional) method of using facial recognition to verify a visitor, according to an embodiment. In FIG. 28, it is assumed that the visitor has already made an appointment (see operations 400-401 and operations 500-501). Thus, in FIG. 4, at operation 402, the method of FIG. 28 can be automatically performed before/without the visitor presenting his/her identification at the scanner at the kiosk (or other similar device). If the visitor is successfully identified via facial recognition at the kiosk, then the operation of the visitor presenting his/her identification to the kiosk can be skipped.

In operation 2800, the visitor appears in front of the kiosk. Once again, the visitor has (or should have) already made an appointment and the visitor is attempting to check in. Thus, at operation 402, the visitor before presenting his/her identification would appear in the kiosk's camera and a picture of the visitor can be taken automatically.

From operation 2800, the method proceeds to operation 2801, which takes the picture of the visitor automatically. Typically, the system would wait until the camera has a good shot (with the visitor's face in full view) before taking the picture.

From operation 2801, the method proceeds to operation 2802, which initiates a search for a match of the picture taken in operation 2801 in the database. A match in this context means identifying a record which is associated with the visitor by matching the visitor's facial features with pictures already in the database. Of course, the picture taken in operation 2801 will not exactly not match any picture in the database because the system is performing facial recognition.

From operation 2802, the method proceeds to operation 2803, which determines whether a face match is found. That is, the picture from operation 2801 would be determined to be the same person as stored in a record in the database. If there is no match, then the method proceeds to operation 2804 which proceeds normally (in other words, another method if identifying the visitor can be used such as proceed to operation 402).

If in operation 2803, a face match is found in the database, then the method proceeds to operation 2805, which determines whether an (upcoming or current) appointment record match is found. If the person from the picture taken in operation 2801 is identified, then it is determined if that person has an appointment record in the database. If not, then the method would proceed to operation 2804, in which another identification method would be used. Note that depending on the implementation, there can be different types of records, for example visitor records (just of visitor's information, such as pictures, license information, such) and appointment record (records storing actual appointments of visitors and tenants and details about the appointment). Or such records can all be combined into the same record/data structure. Thus, once the visitor is identified, it can be determined if that visitor actually has an appointment on the same day (or within a particular time window) that the visitor has presented himself/herself in operation 2800.

If in operation 2805 an upcoming appointment record match is found, that is an appointment record is found for the particular identified visitor (standing in front of the kiosk in operation 2801) which is compatible for the current time (e.g., the appointment in the appointment record is within one hour of the current time) then the method can proceed to operation 2809 and the confirmation can proceed using this appointment record. In operation 2809, the method can proceed for example to operation 408 (or operation 410 if the time check has already been performed) wherein the authorization continues.

Thus, the advantage of utilizing the system illustrated in FIG. 28 is it saves the visitor the step of having to present an identification or QR code, as their face can be the "identification" needed to proceed to "check in" with the system. The facial recognition system can be used any time a "check in" using a physical instrument (e.g., an identification and/or QR code, etc.) would be needed to be presented.

FIG. 29 is a block diagram of a computing device that can be used to implement any computer, server, processing unit, etc., according to an embodiment. This also includes the electronics inside a kiosk and also any device serving as a kiosk (e.g., an electronic output device and a scanner). Any electrical component described herein or needed for operation of the system described herein (including all servers, computers, processing units, cell phones, tablets, personal computers, etc.) can have the hardware illustrated in FIG. 29.

A processing unit 2900 can be a microprocessor and associated structure (e.g., bus, cache, clock, etc.) which can be connected to an input device 2901 (e.g., touch-screen, keyboard, mouse, buttons, etc.) and an output device 2902 (e.g., touch-screen, CRT, monitor, etc.) The processing unit 2900 can also be connected to a network connection 2903 which can connect to a computer communications network such as the Internet, Wi-Fi, LAN, WAN, etc. The processing unit 2900 can also be connected to a ROM 2904 and a RAM 2905 as used in the art. The processing unit 2900 can also be connected to a storage device 2906 which can be nonvolatile storage device (e.g., BLU-RAY drive, CD-ROM drive, hard drive, EPROM, etc.) A non-transitory computer readable storage medium 2907 (e.g., BLU-RAY disc, CD-ROM, memory chip, hard disc, etc.) can be read by the storage device 2906 and can store programs (upon execution by the processing unit 2900) and assets that can cause the processing unit 2900 to perform any and all of the methods/features described herein. The ROM 2904 and RAM 2905 can also be loaded with instructions that can cause (when executed) the processing unit 2900 to perform any and all of the methods described herein. Note that connected as used herein could mean either a physical connection or a wireless connection. In addition, one component can be connected to another component directly or indirectly (through one or more additional components).

Note that one server (or a group of servers) can be considered a "back end system" and work together to implement all of the features described herein, which include communicating with both the kiosk processing unit 800 and the barrier processing unit 700.

All components herein can be distributed across different such components as needed. For example, a single server as mentioned herein can be distributed across numerous different servers and locations. A processor (or processing unit) can also be distributed across multiple processors in a same or different computer (at a same or different location). The electronic components described herein can all communicate with each other, and it can be appreciated that the computer systems implementing the methods herein can be more numerous and interconnected than illustrated herein. An end user can also operate their own server which interfaces with the single server and can control all functionality of the system.

Note that the inventive concepts described herein enables a visitor to carry out all functionality, including viewing a tenant listing, scheduling a tenant list, receiving indicia, and entering the secure areas of the building (e.g., turnstiles) with no touch contact. That is, the visitor can gain access to a secure area of the building (e.g., behind a turnstile/door) without physically touching any electronic device at the building (e.g., touchscreens, etc.) to enter the secure area. While the visitor is still required to touch his/her own cell phone, this is not a problem as presumably people make sure their own cell phone is kept clean and sanitary.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus, comprising:

an output device located in a building comprising a scanner;

a physical barrier located in the building comprising a barrier scanner located in a same physical building as the output device;

at least one processor connected to at least one computer readable storage storing computer readable instructions, the computer readable instructions programmed to cause the at least one processor to perform:

receive a scan on the scanner of an identification card provided by a visitor;

identify a name on the identification card;

display an indicia on the output device;

provide a form associated with the indicia displayed on the output device, on a cell phone of the visitor, the form enabling the visitor on the cell phone of the visitor to provide personal information and identify a tenant;

transmitting a request to the tenant located in the building, the request comprising the personal information and the name; and receive a decision from the tenant, wherein if the decision is an approval then transmit a digital badge to the cell phone of the visitor configured to enable the visitor to pass through the physical barrier, and if the decision is a denial then not transmit the digital badge to the cell phone of the visitor.

2. The apparatus as recited in claim 1, wherein the computer readable instructions are further programmed such that the identification card is a driver's license or passport.

3. The apparatus as recited in claim 1, wherein the computer readable instructions are further programmed such that the indicia is a QR code.

4. The apparatus as recited in claim 1, wherein the physical barrier is a turnstile.

5. The apparatus as recited in claim 1, wherein the computer readable instructions are further programmed such that the form is embedded on a web page which has a uniform resource locator encoded in the indicia.

6. The apparatus as recited in claim 1, wherein the output device is further connected to a no contact infrared thermometer.

7. The apparatus as recited in claim 6, wherein the computer readable instructions are further programmed such that the request comprises a temperature of the visitor taken by the no contact infrared thermometer.

8. The apparatus as recited in claim 1, wherein the computer readable instructions are further programmed such that the request comprises a picture of the visitor taken at the output device.

9. The apparatus as recited in claim 1, wherein the output device and the scanner are housed inside a kiosk.

10. The apparatus as recited in claim 1, wherein the computer readable instructions are further programmed to, upon the visitor further presenting himself or herself to the output device, capture a picture of the visitor and determine using facial recognition whether the visitor has an upcoming appointment.

11. A method, comprising:

executing, on at least one processor, computer readable instructions causing the following operations:

receiving a scan on a scanner of an identification card provided by a visitor, the scanner connected to an output device;

identifying a name on the identification card;

displaying an indicia on the output device;

providing a form associated with the indicia displayed on the output device, on a cell phone of the visitor, the form enabling the visitor to provide personal information and identify a tenant;

transmitting a request to the tenant located in a building, the request comprising the personal information and the name;

receiving a decision from the tenant from a decision set comprising denial and approval; and providing functionality in the computer readable instructions such that if the decision is approval then transmitting a digital badge to the cell phone of the visitor configured to enable the visitor to pass through a physical barrier, and if the decision is denial then not transmitting the digital badge to the cell phone of the visitor, wherein the physical barrier and the output device are located in the building.

12. The method as recited in claim 11, wherein the identification card is a driver's license or passport.

13. The method as recited in claim 11, wherein the indicia is a QR code.

14. The method as recited in claim 11, wherein the physical barrier is a turnstile.

15. The method as recited in claim 11, further comprising embedding the form on a web page which has a uniform resource locator encoded in the indicia.

16. The method as recited in claim 11, wherein the output device is also connected to a no contact infrared thermometer.

17. The method as recited in claim 16, further comprising taking a temperature of the visitor using the no contact infrared thermometer, and the request further comprises the temperature of the visitor.

18. The method as recited in claim 11, further comprising taking a picture of the visitor and the request further comprises the picture of the visitor.

19. The method as recited in claim 11, wherein the output device connected to the scanner are housed inside a kiosk.

20. An apparatus, comprising:

a kiosk located in a building comprising a kiosk scanner and a kiosk output device;

a physical barrier located in the building comprising a barrier scanner located in a same physical building as the kiosk;

at least one processor connected to at least one computer readable storage storing computer readable instructions, the computer readable instructions programmed to cause the at least one processor to perform:

enable a visitor to initiate a first functionality to gain access through the physical barrier when the visitor does not have a scheduled appointment, wherein upon initiation of the first functionality, receive a scan on the kiosk scanner of an identification card provided by the visitor; identify a name on the identification card; display an indicia on the kiosk output device;

provide a form associated with the indicia on the kiosk output device on the visitor's cell phone, the form enabling the visitor on the visitor's cell phone to provide personal information and identify a selected tenant; a request for an appointment is received from the visitor with the selected tenant and the selected tenant is notified of the request and a reply is received from the selected tenant which is a decision in a decision set of approve and deny, if the decision is approve then a badge configured to enable the visitor pass through the physical barrier is transmitted to the visitor, and if the decision is deny then the badge is not transmitted to the visitor, and enable the visitor to initiate a second functionality to gain access through the physical barrier when the visitor does have the scheduled appointment, wherein upon initiation of the second functionality, a particular indicia is scanned from the visitor and if the particular indicia is authorized and a current time and a current date is within a window of the scheduled appointment then the visitor is enabled to pass through the physical barrier.

21. The apparatus as recited in claim 20, wherein the physical barrier is a turnstile.

* * * * *